US007067243B2

(12) United States Patent
Uytterhoeven et al.

(10) Patent No.: US 7,067,243 B2
(45) **Date of Patent: *Jun. 27, 2006**

(54) METHOD FOR PREPARATION OF A PHOTOTHERMOGRAPHIC MATERIAL WITH INCREASED PHOTOSENSITIVITY

(75) Inventors: Herman Uytterhoeven, Bonheiden (BE); Paul Callant, Edegem (BE)

(73) Assignee: Agfa Gevaert, Mortsel (BE)

( * ) Notice: Subject to any disclaimer, the term of this patent is extended or adjusted under 35 U.S.C. 154(b) by 281 days.

This patent is subject to a terminal disclaimer.

(21) Appl. No.: 10/384,321

(22) Filed: Mar. 7, 2003

(65) Prior Publication Data

US 2003/0219685 A1 Nov. 27, 2003

Related U.S. Application Data

(60) Provisional application No. 60/367,011, filed on Mar. 22, 2002.

(30) Foreign Application Priority Data

Mar. 13, 2002 (EP) ..... 02100239

(51) Int. Cl.
*G03C 1/498* (2006.01)
*G03C 1/10* (2006.01)

(52) U.S. Cl. ..... 430/619; 430/577; 430/611; 430/613; 430/620; 430/935; 430/964

(58) Field of Classification Search ..... 430/619, 430/620, 577, 964, 935, 611, 613
See application file for complete search history.

(56) References Cited

U.S. PATENT DOCUMENTS 3,761,279 A 9/1973 de Mauriac et al.
3,769,026 A * 10/1973 Shiba et al. ..... 430/577
4,617,257 A 10/1986 Sawada et al.
5,281,515 A * 1/1994 Delprato et al. ..... 430/577
5,482,814 A * 1/1996 Ooi et al. ..... 430/203
5,529,889 A * 6/1996 Ueda et al. ..... 430/353
5,922,529 A 7/1999 Tsuzuki et al.
6,528,244 B1 * 3/2003 Katoh et al. ..... 430/619
6,576,415 B1 * 6/2003 Uytterhoeven et al. ..... 430/620

FOREIGN PATENT DOCUMENTS

WO WO 98/45754 A2 10/1998

* cited by examiner

*Primary Examiner*—Thorl Chea
(74) *Attorney, Agent, or Firm*—Leydig, Voit & Mayer, Ltd.

(57) ABSTRACT

A process for preparing a photothermographic material with increased photosensitivity, the photothermographic material comprising a support and a photo-addressable thermally developable element, exclusive of a compound R—S(M)$_n$ wherein R is an aliphatic hydrocarbon, aryl or heterocyclic group, M is a hydrogen atom, or cation, and letter n is a number determined so as to render the molecule neutral and also exclusive of a compound capable of releasing a mobile dye corresponding to or inversely corresponding to the reduction of silver halide to silver at elevated temperatures, the photo-addressable thermally developable element containing a photosensitive agent in catalytic association with a light-insensitive organic silver salt, a reducing agent for the light-insensitive organic silver salt in thermal working relationship therewith and a binder, comprising the steps of: (i) increasing the photosensitivity of a photosensitive silver halide by chemical sensitisation with a chemical sensitising merocyanine dye containing a thione group in a non-oxidative aqueous medium, optionally in the presence of the light-insensitive organic silver salt, thereby producing the photosensitive agent; (ii) coating the support with one or more aqueous solutions or dispersions together containing the light-insensitive organic silver salt, the photosensitive agent, the reducing agent and the binder; (iii) drying the coating or coatings thereby producing the photo-addressable thermally developable element.

15 Claims, No Drawings

METHOD FOR PREPARATION OF A PHOTOTHERMOGRAPHIC MATERIAL WITH INCREASED PHOTOSENSITIVITY

The application claims the benefit of U.S. Provisional Application No. 60/367,011 filed Mar. 22, 2002, which is herein incorporated by reference.

FIELD OF THE INVENTION

The present invention relates to a photothermographic material with increased photosensitivity and to a process for preparing a photothermographic material with increased photosensitivity.

BACKGROUND OF THE INVENTION

Thermal imaging or thermography is a recording process wherein images are generated by the use of thermal energy. In direct thermal imaging a visible image pattern is formed by imagewise heating of a recording material. Such thermographic materials become photothermographic when a photosensitive agent (e.g. a photosensitive silver halide) is present which after exposure to UV, visible or IR light is capable of catalyzing or participating in a process bringing about changes in colour or optical density under the influence of heat.

Examples of photothermographic materials are the so called "Dry Silver" photographic materials of the 3M Company, which are reviewed by D. A. Morgan in Chapter 2 of the "Handbook of Imaging Science", edited by A. R. Diamond, pages 43–60, published by Marcel Dekker in 1991. The photothermographic process is based on the light sensitivity of silver halide (e.g. silver bromide) and the heat developability of organic silver salts (e.g. silver behenate). The silver halide utilized in dry silver is similar to that used in classical photography but with some significant differences: in photothermography the particle size of the silver halide is smaller and the amount of the silver halide is lower than in classical silver halide emulsion layers. It is important for high sensitivity and for realising high image contrast that the silver halide grains be dispersed in the organic silver salt and be in synergistic association with the organic silver salt particles.

The Theory of the Photographic Process Fourth Edition, edited by T. H. James, Eastman Kodak (1977), pages 149–160 discuss the sensitization of silver halide in classical silver halide emulsions. The chemical sensitization involved may be of one or more of: reduction, sulfur, gold sensitization. In such processes, chemical sensitization is obtained by adding a certain compound ("sensitizer") to the silver halide emulsion, possibly resulting in a higher speed i.e. a higher photographic sensitivity. For sulfur-sensitization certain compounds with labile sulfur atoms, such as thiosulfate, thiourea or allylthiourea, are used.

U.S. Pat. No. 3,761,279 discloses a photothermographic element comprising a support having thereon (a) an oxidation-reduction image-forming combination comprising the reducing agent 2,2'-dihydroxy-1,1'-binaphtyl and silver behenate, (b) photosensitive silver halide, (c) a sensitising dye comprising 3-carboxymethyl-5-[(3-methyl-2-(3H)-thiazolidene)isopropylidene]rhodanine, (d) an activator-toning agent comprising phtalimide, and (d) a binder comprising polyvinylbutyral. The described combination provides a photothermographic material with improved properties such as an increased photosensitivity, faster development, higher maximum density, a more neutral tone and less background density due to post-processing print-out. The described combination can also contain a divalent metal salt image amplifier, an image stabilizer precursor and a photographic speed increasing onium halide. However, the invention was only exemplified in solvent medium, and the invention is only enabled for dispersions of silver behenate and in-situ formed silver halide in a solvent medium.

EP-A 1 132 767 discloses a photothermographic material comprising on a support a light sensitive layer containing an organic silver salt, light sensitive silver halide grains and a solvent, wherein the organic silver salt comprises tabular organic silver salt grains exhibiting an average needle ratio of not less than 1.1 and less than 10.0, the light sensitive silver halide grains having been subjected to chemical sensitization. An enhanced sensitivity can be obtained by chemical sensitization of the silver halide using an organic sensitizer containing a chalcogen atom, but this process is only exemplified in an organic solvent environment.

WO 98/45754 discloses a method for chemically sensitizing silver halide grains in a photothermographic emulsion comprising the steps of: (a) providing a photothermographic emulsion comprising silver halide grains and a non-photosensitive silver source; (b) providing a sulfur-containing compound positioned on or around the silver halide grains; and (c) sensitizing the silver halide grains by decomposing the sulfur-containing compound on or around the silver halide grains. As exemplified in this sensitizing step the sulfur-containing compound only decomposes under the influence of an oxidizing agent such as pyridinium-bromide-perbromide. Furthermore, this sensitization process is only exemplified in organic solvent media.

U.S. Pat. No. 5,922,529 discloses a photothermographic material comprising a binder, an organic silver salt, a reducing agent for silver ion, and photosensitive silver halide grains on at least one surface of a support, wherein a photosensitive layer containing the photosensitive silver halide grains further contains a compound of the formula (I) and a compound of the formula (II), and said photosensitive layer has an absorbance of 0.15 to 1.0 at an exposure wavelength, $$R—S(M)_n \qquad (I)$$

wherein R is an aliphatic hydrocarbon, aryl or heterocyclic group, M is a hydrogen atom, or cation, and letter n is a number determined so as to render the molecule neutral,

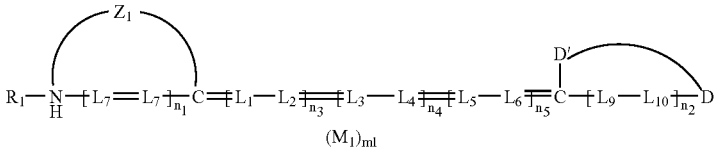

wherein $Z_1$ is a group of atoms necessary to form a 5- or 6-membered nitrogenous heterocycle, each of D and D' is a group of atoms necessary to form an acyclic or cyclic acidic nucleus, $R_1$ is an alkyl group, $L_1$, $L_2$, $L_3$, $L_4$, $L_5$, $L_6$, $L_7$, $L_8$, $L_9$, and $L_{10}$ each are a methine group, which may form a ring with another methine group or a ring with an auxochrome, letters $n_1$, $n_2$, $n_3$, $n_4$, and $n_5$ each are equal to 0 or 1, $M_1$ is an electric charge neutralizing counter ion, and letter m1 is an integer inclusive of 0 necessary to neutralize an electric charge in a molecule.

U.S. Pat. No. 4,617,257 discloses a heat developable light-sensitive material which is sufficiently stable to be stored for a long time at a predetermined sensitivity, comprising a light-sensitive silver halide spectrally sensitized with a dye represented by formula (I) or (II):

(I)

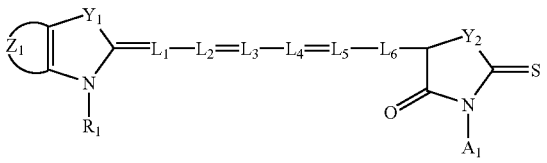

wherein $R_1$ represents an alkyl group or a substituted alkyl group, $A_1$ represents an alkyl group, a substituted alkyl group, a phenyl group, a substituted phenyl group, a pyridyl group, or a substituted pyridyl group, $Y_1$ represents an oxygen atom, a sulfur atom, a selenium atom,

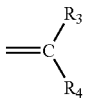

(wherein $R_3$ and $R_4$ each represents a methyl group or an ethyl group), $=N—R_5$ (wherein $R_5$ represents an alkyl group or a substituted alkyl group containing not more than 5 carbon atoms, or an allyl group), or —C=CH—, $Y_2$ represents an oxygen atom, a sulfur atom, or $=N\text{-}A_2$, (wherein $A_2$ represents an alkyl or substituted alkyl group containing not more than 5 carbon atoms, an allyl group, a phenyl group, a substituted phenyl group, a pyridyl group, or a substituted pyridyl group), $Z_1$ represents atoms forming an unsubstituted or substituted benzene or naphthalene ring; and $L_1$ through $L_6$ each represents a methine or substituted methine group, wherein $L_2$ and $L_4$ or $L_4$ and $L_6$ can bonded to each other to form a 5- or 6-membered ring;

(II)

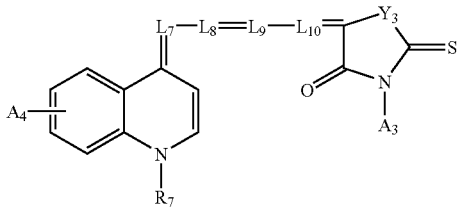

wherein $Y_3$, $R_7$, and $A_3$ represent the same atoms or groups as defined for $Y_2$, $R_1$, and $A_1$, respectively; $A_4$ represents an alkyl group containing from 1 to 4 carbon atoms, a halogen atom, a phenyl group, a hydroxyl group, an alkoxy group containing from 1 to 4 carbon atoms, a carboxyl group, an alkoxycarbonyl group, an alkylsulfamoyl group, an alkylcarbamoyl group, an acyl group, a cyano group, a trifluoromethyl group, or a nitro group; and $L_7$ through $L_{10}$ each represents a methine or substituted methine group, wherein the substituent is an alkyl group, a substituted alkyl group, an aryl group, or an alkoxy group, wherein said material further comprises at least one of a compound being capable of releasing a mobile dye corresponding to or inversely corresponding to the reduction of silver halide to silver at elevated temperatures and an alkali or alkali precursor.

Prior art processes for preparing photothermographic materials with high photosensitivity prepare the organic silver salt and the silver halide in aqueous media, but instead of continuing in aqueous media the organic silver salt/silver halide are separated off and dried before being dispersed in an organic solvent medium. This is inherently inefficient and also environmentally unsound as evaporation of solvent takes place during the coating process and this solvent either is vented or has to be recovered with expenditure of energy. Furthermore it involves lengthy utilization of plant during the preparation of the organic silver salt dispersion and coating requires costly plant due to the need for solvent explosion prevention measures.

For ecological and economic reasons, a process is therefore required for producing photothermographic recording materials with high photosensitivity from aqueous media.

The classical chemical sensitization procedures known from classical silver halide emulsion photography are ineffective in boosting the photosensitivity of photothermographic materials. In fact photothermographic materials are distinguished from classical silver halide emulsion materials by their significantly lower photosensitivities.

A means of boosting the photosensitivity of photothermographic materials coated from aqueous media is therefore required.

ASPECTS OF THE INVENTION

It is an aspect of the present invention to provide a process for chemically sensitizing silver halide grains in an aqueous dispersion.

It is a further aspect of the present invention to provide a process for producing a photothermographic material comprising a support and a photo-addressable thermally developable element, comprising the steps of chemically sensitizing silver halide grains; and coating the photo-addressable thermally developable element from an aqueous medium.

It is also an aspect of the present invention to provide a process for producing a high photosensitivity photothermographic material with excellent image-forming properties by coating from an aqueous medium.

It is also an aspect of the present invention to provide materials with an increased photosensitivity obtainable by these processes.

Further aspects and advantages of this invention will become apparent from the description hereinafter.

SUMMARY OF THE INVENTION

In an organic solvent medium chemical sensitization of silver halide by decomposition of sulfur containing sensitizing dyes is a known technique for increasing the sensitivity of photothermographic emulsions. However, this process has only been exemplified in the presence of oxidizing agents such as a compound containing a perbromide group in an organic solvent medium. Surprisingly, it has been found that silver halide grains can be chemically sensitized in aqueous media without the need for the presence of oxidizing agents. Such chemical sensitization can be carried out with merocyanine dyes, exclusive of an —SH group, containing a thione group.

Aspects of the present invention are realised by a process for preparing a photothermographic material with increased photosensitivity, the photothermographic material comprising a support and a photo-addressable thermally developable element, exclusive of a compound R—S(M)$_n$ wherein R is an aliphatic hydrocarbon, aryl or heterocyclic group, M is a hydrogen atom, or cation, and letter n is a number determined so as to render the molecule neutral and also exclusive of a compound capable of releasing a mobile dye corresponding to or inversely corresponding to the reduction of silver halide to silver at elevated temperatures, the photo-addressable thermally developable element containing a photosensitive agent in catalytic association with a light-insensitive organic silver salt, a reducing agent for the light-insensitive organic silver salt in thermal working relationship therewith and a binder, comprising the steps of: (i) increasing the photosensitivity of a photosensitive silver halide by chemical sensitisation with a chemical sensitising merocyanine dye containing a thione group in a non-oxidative aqueous medium, optionally in the presence of the light-insensitive organic silver salt, thereby preparing the photosensitive agent; (ii) coating the support with one or more aqueous solutions or dispersions together containing the light-insensitive organic silver salt, the photosensitive agent, the reducing agent and the binder; (iii) drying the coating or coatings thereby producing the photo-addressable thermally developable element.

Aspects of the present invention are also realised by a process for preparing a photothermographic material with increased photosensitivity, the photothermographic material comprising a support and a photo-addressable thermally developable element, exclusive of a compound R—S(M)$_n$ wherein R is an aliphatic hydrocarbon, aryl or heterocyclic group, M is a hydrogen atom, or cation, and letter n is a number determined so as to render the molecule neutral and also exclusive of a compound capable of releasing a mobile dye corresponding to or inversely corresponding to the reduction of silver halide to silver at elevated temperatures, the photo-addressable thermally developable element containing a photosensitive agent in catalytic association with a light-insensitive organic silver salt, a reducing agent for the light-insensitive organic silver salt in thermal working relationship therewith, a silver salt having a water-solubility of greater than 0.1 g in 1 L water at 20° C. and a binder, comprising the steps of: (i) increasing the photosensitivity of a photosensitive silver halide by chemical sensitisation with a chemical sensitising merocyanine dye containing a thione group in a non-oxidative aqueous medium, optionally in the presence of said light-insensitive organic silver salt and/or in the presence of the silver salt having a water-solubility of greater than 0.1 g in 1 L water at 20° C., thereby producing said photosensitive agent; (ii) coating the support with one or more aqueous solutions or dispersions together containing the light-insensitive organic silver salt, the photosensitive agent, the reducing agent and the binder; (iii) drying the coating or coatings thereby producing the photo-addressable thermally developable element.

Aspects of the present invention are also provided the use of a photosensitive silver halide chemically sensitised with a chemical sensitising merocyanine dye containing a thione group in a non-oxidative aqueous medium for increasing the photosensitivity of a photo-thermographic material comprising a support and a photo-addressable thermally developable element, exclusive of a compound R—S(M)$_n$ wherein R is an aliphatic hydrocarbon, aryl or heterocyclic group, M is a hydrogen atom, or cation, and letter n is a number determined so as to render the molecule neutral and also exclusive of a compound capable of releasing a mobile dye corresponding to or inversely corresponding to the reduction of silver halide to silver at elevated temperatures, the photo-addressable thermally developable element containing a photosensitive agent in catalytic association with a light-insensitive organic silver salt, a reducing agent for the light-insensitive organic silver salt in thermal working relationship therewith and a binder.

Aspects of the present invention are also provided by a photothermographic material with increased photosensitivity obtainable by the above mentioned processes.

Further preferred embodiments of the present invention are disclosed in the claims.

DETAILED DESCRIPTION OF THE INVENTION

Definitions

Photosensitive agent as used in this specification means photosensitive silver halide which has been chemically sensitized with a merocyanine dye, exclusive of an —SH group, containing a thione group in an non-oxidative aqueous medium.

Non-oxidative aqueous medium as used in this specification means an aqueous medium which does not contain a compound capable of oxidizing a merocyanine dye, exclusive of an —SH group, containing a thione group.

A thione group is a —C(═S)— group, otherwise known as a thiocarbonyl group.

Chemically sensitizing merocyanine dye, exclusive of an —SH group, containing a thione group for the purposes of the present invention is a merocyanine dye containing a thione group capable of chemically sensitizing photosensitive silver halide, thereby increasing its photosensitivity and is used, according to the present invention, for preparing the photosensitive agent.

Merocyanine dye as used in this specification means a compound which belongs to any of a class of polymethine dyes that are used like the cyanine dyes but differ from the cyanine dyes in containing an acidic heterocyclic ring linked to a basic heterocyclic ring, in not being ionized and in not having an —SH group. Such merocyanine dyes are described and exemplified in "The Theory of the Photographic Process, Fourth Edition," edited by T. H. James, Eastman Kodak (1977), pages 194–234.

CSMD is an abbreviation for a chemically sensitizing merocyanine dye.

NCSA is an abbreviation for a non-chemically sensitive agent.

The term aqueous for the purposes of the present invention includes mixtures of water with up to 40% by volume, preferably up to 20% by volume, of water-miscible organic solvents such as alcohols e.g. methanol, ethanol, 2-propanol, butanol, iso-amyl alcohol, octanol and cetyl alcohol; glycols e.g. ethylene glycol; glycerine; N-methyl pyrrolidone; methoxypropanol; and ketones e.g. 2-propanone and 2-butanone.

Substantially light-insensitive means not intentionally light sensitive.

Substantially water-insoluble means a solubility in water at 20° C. of less than 2 mg/L.

Water-soluble means a solubility in water at 20° C. of at least 2 mg/L.

Sensitivity (S) is defined as that exposure in $mJ/m^2$ at which the photothermographic recording material attained an optical density of 1.0 above Dmin after processing as measured with a MacBeth™ TR924 densitometer with a visible filter. Thus the lower the value of S, the higher is the photosensitivity of the photothermographic recording material.

The UAg of an aqueous liquid is defined in this specification as the potential difference between a 99.99% pure silver electrode in the aqueous liquid and a reference electrode consisting of a Ag/AgCl-electrode in 3M KCl solution at room temperature connected with the liquid via a salt bridge consisting of a 10% $KNO_3$ salt solution.

By the term "heat solvent" in this specification is meant a non-hydrolyzable organic material which is in solid state in the recording layer at temperatures below 50° C. but becomes a plasticizer for the recording layer in the heated region and/or liquid solvent for at least one of the redox-reactants, e.g. the reducing agent for the substantially light-insensitive and substantially water-insoluble organic silver salt, at a temperature above 60° C.

By thermally developable under substantially water-free conditions as used is the present specification, means heating at a temperature of 80° to 250° C. under conditions in which the reaction system is approximately in equilibrium with water in the air, and water for inducing or promoting the reaction is not particularly or positively supplied from the exterior of the thermographic recording material. Such a condition is described in T. H. James, "The Theory of the Photographic Process, Fourth Edition, Macmillan 1977, page 374.

Process for Preparing the Photosensitive Agent

The processes for preparing a photothermographic material with increased photosensitivity, according to the present invention, include a process for preparing the photosensitive agent. The photosensitive agent, according to the present invention, is prepared by chemical sensitization of a photosensitive silver halide with a chemical sensitising merocyanine dye, exclusive of an —SH group, containing a thione group in a non-oxidising aqueous medium. This process optionally takes place in the presence of an aqueous dispersion of a light-insensitive organic silver salt; or in the presence of an aqueous solution or dispersion of a silver salt having a water-solubility greater than 0.1 g in 1 L water at 20° C.; or in the presence of an aqueous dispersion of a light-insensitive organic silver salt and an aqueous solution or dispersion of a silver salt having a water-solubility greater than 0.1 g in 1 L water at 20° C.

In the preparation of the photo-addressable thermally developable element the chemically sensitizing merocyanine dye can be added before or after each other ingredient. If the reducing agent is added to the aqueous dispersion containing photosensitive silver halide, light-insensitive organic silver salt and chemically sensitizing merocyanine dye, the chemical sensitization must be completed prior to its addition, because the reducing agent may reduce any chemically sensitizing merocyanine dye present and may reduce the potlife of the dispersion due to possible fog formation.

The chemical sensitizing merocyanine dye is added to the photosensitive silver halide emulsion, optionally in the presence of a light-insensitive organic silver salt. The chemically sensitizing merocyanine dye is preferably added to the photosensitive silver halide emulsion with the light-insensitive organic silver salt being added next and then adding the other ingredients.

Chemical sensitization can occur during the period between the addition of the chemically sensitizing merocyanine dye and the coating of the aqueous dispersion containing the silver halide and organic silver salt, but should be substantially completed before any reducing agent is added. The speed of the chemical sensitization process will vary with the temperature of the dispersion in which it takes place.

During this chemical sensitization process the chemically sensitizing merocyanine dye, exclusive of an —SH group, is decomposed on or around the silver halide grains in an aqueous medium.

In this chemical sensitization process the temperature of the dispersion is preferably between 6° C. and 80° C., particularly preferably between 15° C. and 60° C., and especially preferably between 20° C. and 50° C. Depending upon the temperature of the dispersion the duration of the chemically sensitizing process will vary widely. It preferably takes between 30 minutes and 72 hours, particularly preferably between 60 minutes and 24 hours, and especially between 2 hours and 10 hours.

The chemical sensitization is typically carried out in a pH range between 4.5 and 7, particularly preferably between 4.5 and 6.5, especially between 4.5 and 6.

The UAg of the dispersion can also be important, as is shown by the reduced photosensitivity (higher S-values) observed with directly comparable photothermographic recording materials in which no silver nitrate was added. However, in the case of addition of chemically sensitizing merocyanine dye at point C an inferior photosensitivity was observed compared to regime D in which no silver nitrate was added. The UAg can be increased by adding a water-soluble silver salt, such as silver nitrate, before or after adding the chemically sensitizing merocyanine dye. The UAg is preferably between 270 mV and 450 mV, particularly preferably between 300 mV and 430 mV, especially between 350 mV and 425 mV.

The quantity of chemical sensizing merocyanine dye added is preferably between 2 mmol (=millimol) and 50 mmol with respect to 1 mol of the photosensitive silver halide; particularly preferably between 3 and 30 mmol with respect to 1 mol of the photosensitve silver halide; especially between 4 and 20 mmol with respect to 1 mol of the photosensitive silver halide.

According to a first embodiment of the process for preparing a photothermographic recording material with increased photosensitivity, according to the present invention, the photosensitive silver halide is chemically sensitised with at least two of said chemical sensitising merocyanine dyes, exclusive of an —SH group, containing a thione group in a non-oxidative aqueous medium.

Photothermographic Material with Increased Photosensitivity

According to a first embodiment of the photothermographic material with increased photosensitivity produced according to the process, according to the present invention, the photothermographic material is thermally developable under substantially water-free conditions.

According to a second embodiment of the photothermographic material with increased photosensitivity produced according to the process, according to the present invention, the photothermographic material is a monosheet material i.e. not requiring one or more further sheets in contact to produce an image.

According to a third embodiment of the photothermographic material with increased photosensitivity produced according to the process, according to the present invention, the photothermographic material is a back and white photothermographic material.

Photo-Addressable Thermally Developable Element

The photo-addressable thermally developable element comprises one or more layers and contains a photosensitive agent, a substantially light-insensitive organic silver salt, a reducing agent for the substantially light-insensitive organic silver salt and a binder; and optionally a water-soluble silver salt with a solubility in water at 20° C. greater than 0.1 g/L, a toning agent and one or more stabilizers. The photosensitive agent should be present in such a way that it is in catalytic association with the substantially light-insensitive organic silver salt. The reducing agent should be present in such a way that it is able to diffuse to the particles of the substantially light-insensitive organic silver salt so that reduction thereof can take place and the toning agent and one or more stabilizers should be able to interact with the the substantially light-insensitive organic silver salt and the reducing agent therefor.

The photo-addressable thermally developable element may also be coated with a protective layer.

Chemically Sensitizing Merocyanine Dye

According to a second embodiment of the processes for preparing a photothermographic material with increased photosensitivity, according to the present invention, the chemically sensitizing merocyanine dye, exclusive of an —SH group, containing a thione group is capable of spectrally sensitizing the photosensitive silver halide.

According to a third embodiment of the processes for preparing a photothermographic material with increased photosensitivity, according to the present invention, the chemically sensitizing merocyanine dye, exclusive of an —SH group, containing a thione group is a dye containing a rhodanine ring, a thiohydantoin ring, a thiobarbituric acid ring or a 2-thio-4-oxo-oxazolidine ring. These rings are optionally substituted with alkyl, substituted alkyl, aryl, substituted aryl, arylalkyl, substituted arylalkyl, heteroaryl, substituted heteroaryl; preferably methyl, ethyl, hydroxy ethyl, $—(CH_2)_r—COOH$ or salts, $—(CH_2)_s—SO_3H$ or salts, $—(CH_2)_r—CO—NH—SO_2—R_8$ or salts, $—(CH_2)_s—SO_2—NH—CO—R_8$ or salts, $—(CH_2)_s—SO_2—NH—SO_2—R_8$ or salts, carboxy-methyl, carboxy-ethyl, 2-sulpho-ethyl, 3-sulpho-propyl, 4-sulpho-butyl, $—CH_2—CO—NH—SO_2—CH_3$, wherein $R_8$ is selected from alkyl, substituted alkyl; r is 1, 2, 3, 4, 5 or 6; s is 2, 3 or 4.

According to a fourth embodiment of the processes for preparing a photothermographic material with increased photosensitivity, according to the present invention, the chemically sensitizing merocyanine dye, exclusive of an —SH group, containing a thione group is represented by one of the following general structures (I), (II) or (III) wherein (I) =

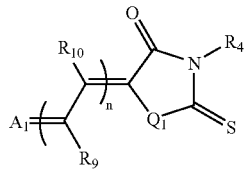

(II) =

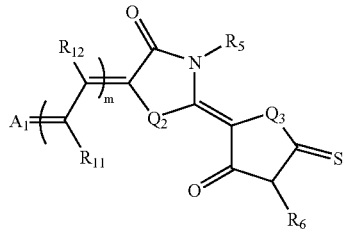

(III) =

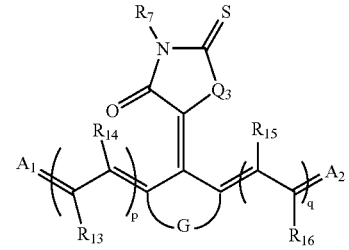

wherein $A_1$ or $A_2$ are each independently selected from one of the following structures:

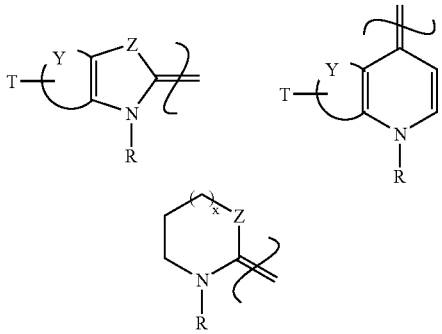

R selected from alkyl, substituted alkyl, arylalkyl, substituted arylalkyl; preferably methyl, ethyl, hydroxy ethyl, —$(CH_2)_r$—COOH or salts, —$(CH_2)_s$—$SO_3H$ or salts, —$(CH_2)_r$—CO—NH—$SO_2$—$R_3$ or salts, —$(CH_2)_s$—$SO_2$—NH—CO—$R_3$ or salts, —$(CH_2)_s$—$SO_2$—NH—$SO_2$—$R_3$ or salts, carboxy-methyl, carboxy-ethyl, 2-sulpho-ethyl, 3-sulpho-propyl, 4-sulpho-butyl, —$CH_2$—CO—NH—$SO_2$—$CH_3$ or salts; $Q_1$, $Q_2$ and $Q_3$ are independently selected from —O—, —S—, —$NR_1$—, —CO—$NR_2$—; $R_1$ is selected from alkyl, substituted alkyl, aryl, substituted aryl, heteroaryl, substituted heteroaryl; $R_2$ is selected from —H, alkyl, substituted alkyl; $R_3$ is selected from alkyl, substituted alkyl; $R_4$ to $R_7$ are each independently selected from alkyl, substituted alkyl, aryl, substituted aryl, arylalkyl, substituted arylalkyl, heteroaryl, substituted heteroaryl; preferably methyl, ethyl, hydroxy ethyl, —$(CH_2)_r$—COOH or salts, —$(CH_2)_s$—$SO_3H$ or salts, —$(CH_2)_r$—CO—NH—$SO_2$—$R_8$ or salts, —$(CH_2)_s$—$SO_2$—NH—CO—$R_8$ or salts, —$(CH_2)_S$—$SO_2$—NH—$SO_2$—$R_8$ or salts, carboxy-methyl, carboxy-ethyl, 2-sulpho-ethyl, 3-sulpho-propyl, 4-sulpho-butyl, —$CH_2$—CO—NH—$SO_2$—$CH_3$ or salts; $R_8$ is selected from alkyl, substituted alkyl; $R_9$ to $R_{16}$ are each independently selected from —H, methyl, ethyl, isopropyl, phenyl, substituted phenyl, benzyl, substituted benzyl, cyclopropyl, —$(CH_2)_2$—COOH or salts; n, m, p and q are each independently 0, 1, 2 or 3; preferably 0 or 1; r is 1, 2, 3, 4, 5 or 6; s is 2, 3 or 4; x is 0 or 1; Z is selected from —O—, —S—, —$NR_1$—, —CH═CH—, —$C(CH_3)_2$—; G represents the atoms necessary to complete a carbocyclic ring or a heterocyclic ring; Y represents the atoms necessary to complete a carbocyclic ring or a heterocyclic ring; T is selected from alkyl, —Cl, —Br, —I, alkoxy, methoxy, ethoxy, hydroxy, —S—$CH_3$, phenyl, substituted phenyl, annulated benzo-ring, 1-indolyl, 1-pyrrolyl, 2-pyrrolyl, 3-pyrrolyl, 2-thienyl, 3-thienyl, 2-furyl, 3-furyl, —NH—CO—$R_{17}$, —CO—$NHR_{17}$, —NH—CO—$NHR_{17}$, —NH—$SO_2$—$NHR_{17}$, —CN, —$CF_3$, —$SO_2$—$CF_3$, —$SO_2$—$CH_3$, —$SO_2$—$NR_2R_3$, —$CO_2$—$R_2$, —CO—$NR_2R_2$; $R_{17}$ is from an alkyl containing 1 to 6 carbon atoms, 2-furyl, 2-thienyl. According to a fifth embodiment of the processes for preparing a photothermographic material with increased photosensitivity, according to the present invention, the chemically sensitizing merocyanine dye, exclusive of an —SH group, containing a thione group is selected from the group consisting of:

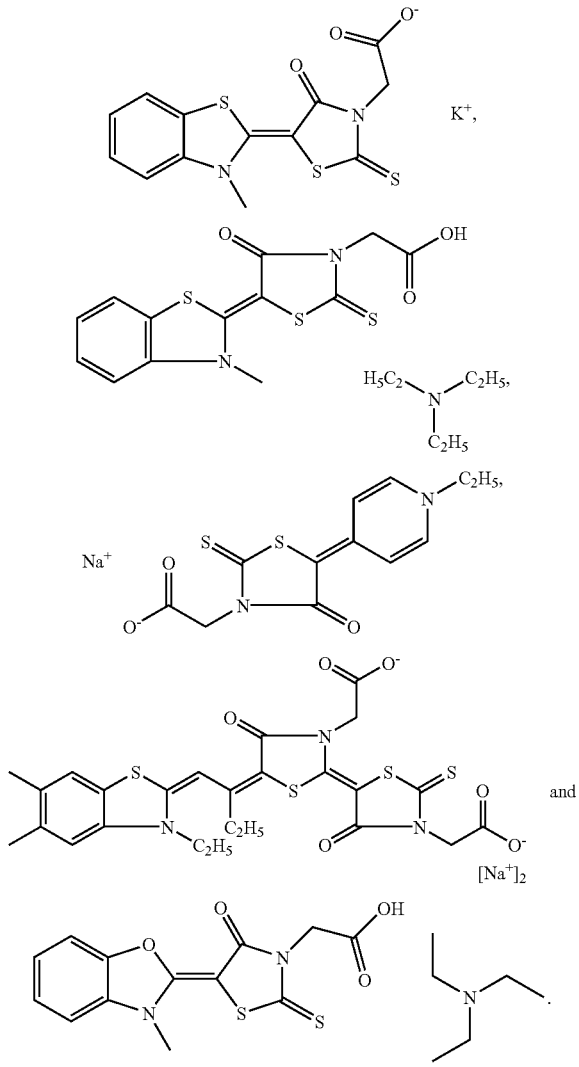

The chemically sensitizing merocyanine dye containing a thione group as represented by one of the following general structures (I), (II) or (III) may be N-substituted with groups containing anionic function or an acid function. A base may be added in the case the N-substituent contains an acid function.

Suitable chemically sensitizing merocyanine dyes containing a thione group according to the present invention are:

CSMD01

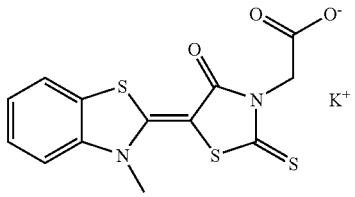

-continued
CSMD02
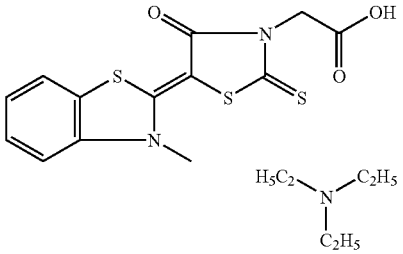
CSMD03
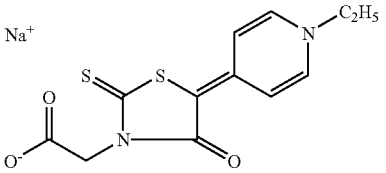
CSMD04
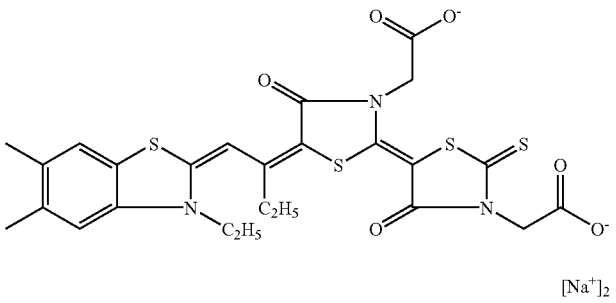
CSMD05
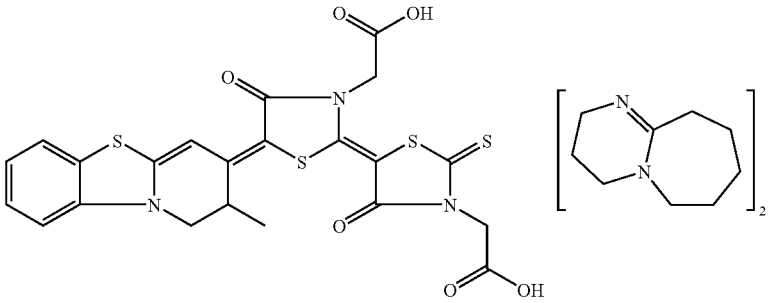
CSMD06
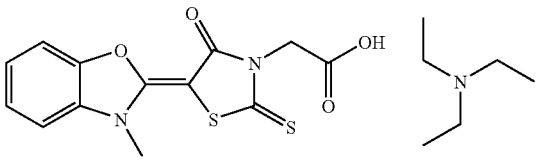
CSMD07
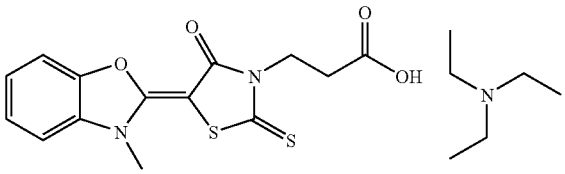
CSMD08
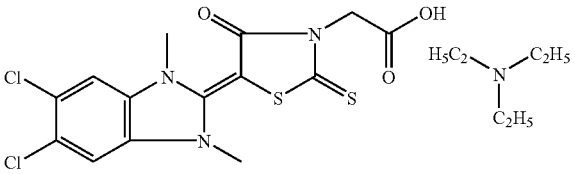

-continued
CSMD09
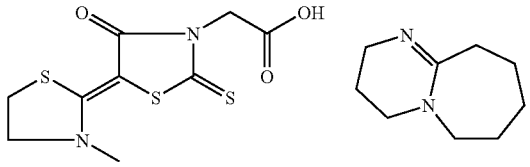
CSMD10
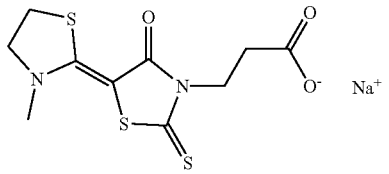
CSMD11
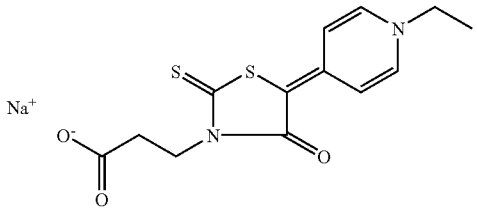
CSMD12
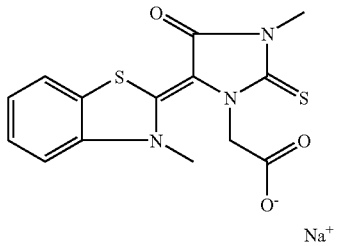
CSMD13
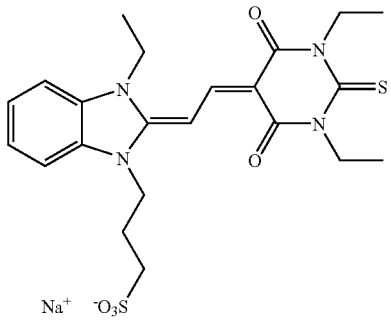
CSMD14
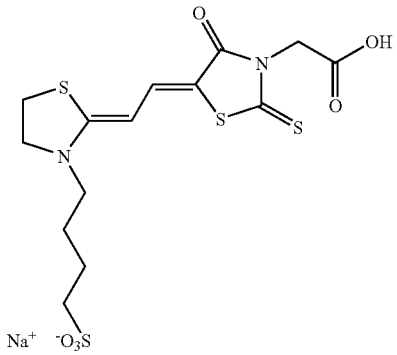

-continued
CSMD15
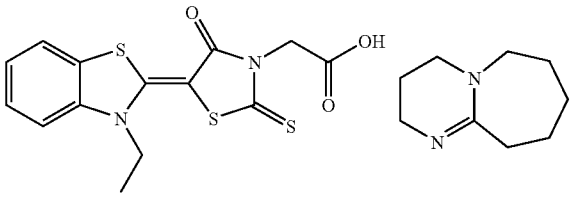
CSMD16
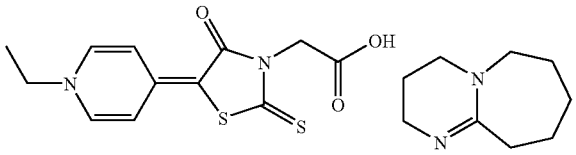
CSMD17
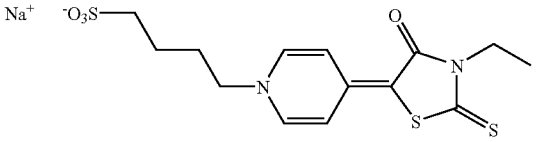
CSMD18
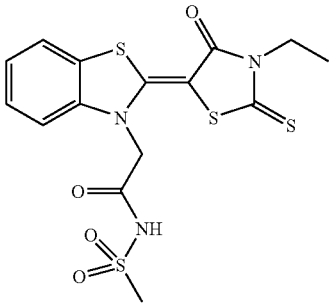
CSMD19
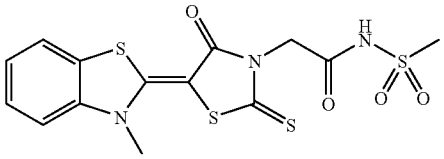
CSMD20
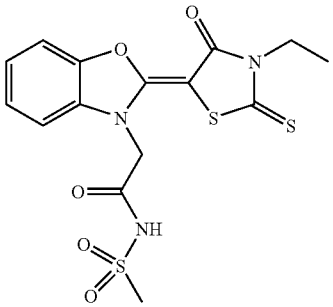
CSMD21
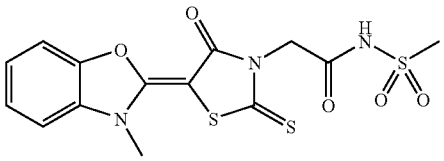

-continued
CSMD22
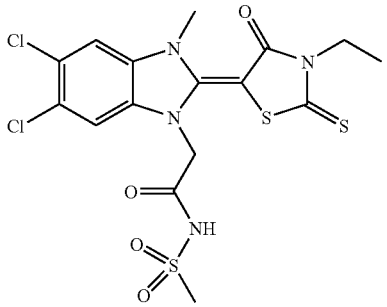
CSMD23
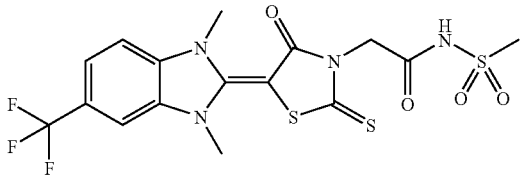
CSMD24
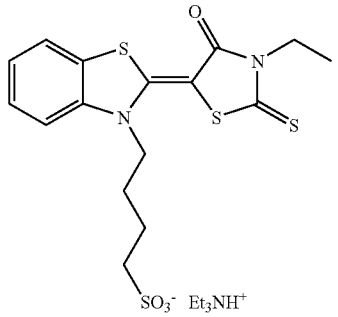
CSMD25
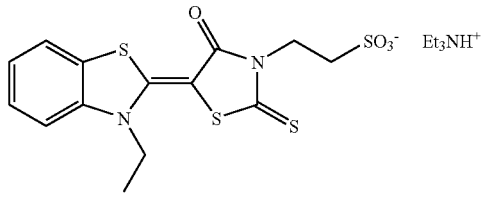
CSMD26
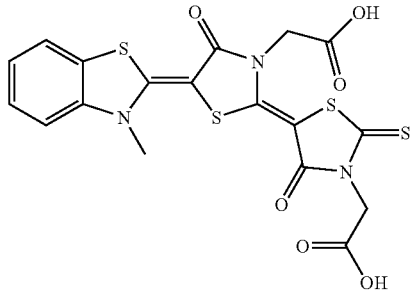

-continued
CSMD27
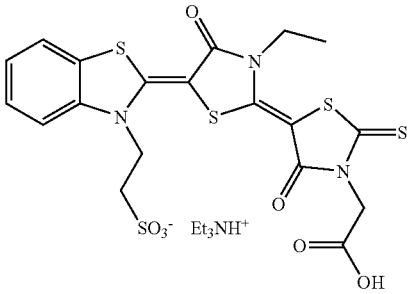
CSMD28
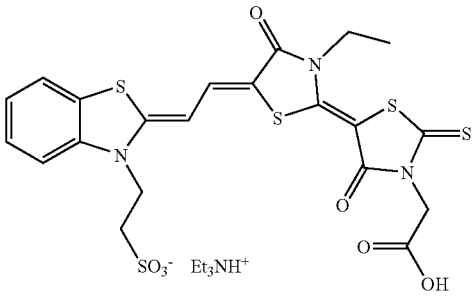
CSMD29
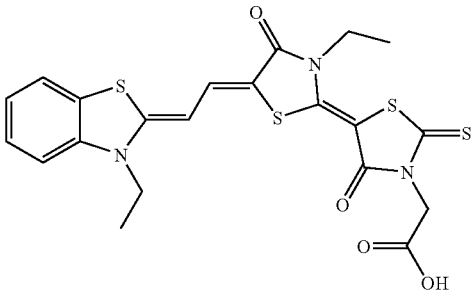
CSMD30
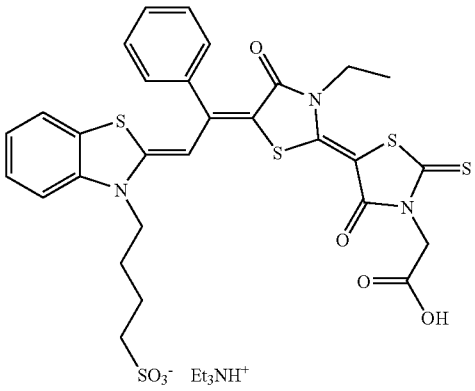
CSMD31
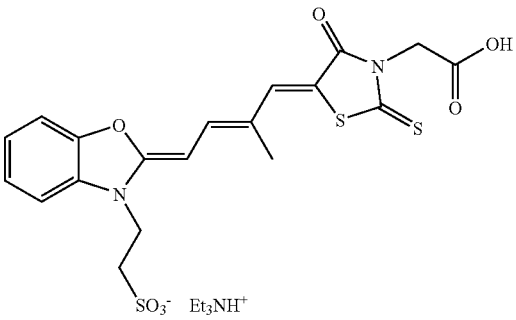

-continued

CSMD32

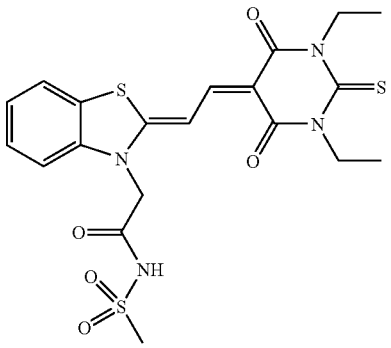

CSMD33

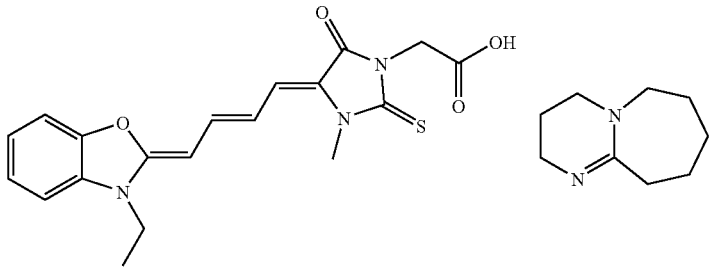

CSMD34

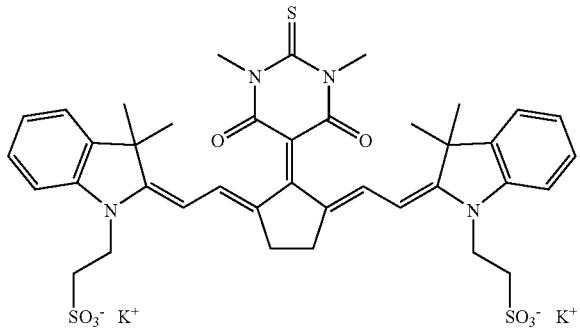

CSMD35

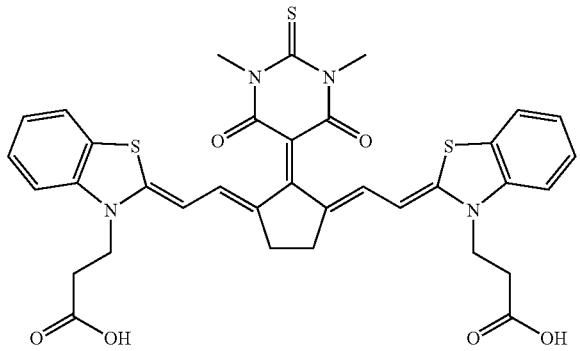

Photosensitive Silver Halide

The photosensitive silver halide used in the present invention may be employed in a range of 0.1 to 100 mol percent; preferably, from 0.2 to 80 mol percent; particularly preferably from 0.3 to 50 mol percent; especially preferably from 0.5 to 35 mol %; and especially from 1 to 12 mol % of substantially light-insensitive organic silver salt.

The silver halide may be any photosensitive silver halide such as silver bromide, silver iodide, silver chloride, silver bromoiodide, silver chlorobromoiodide, silver chlorobromide etc. The silver halide may be in any form which is photosensitive including, but not limited to, cubic, orthorhombic, tabular, tetrahedral, octagonal etc. and may have epitaxial growth of crystals thereon.

The silver halide used in the present invention is chemically sensitized with a chemical sensitising merocyanine dye containing a thione group, and optionally with a chemically sensitizing agent such as a compound containing sulphur, selenium, tellurium etc., or a compound containing gold, platinum, palladium, iron, ruthenium, rhodium or iridium etc. in addition to sensitization with specific reducing agents, according to the present invention. The details of these procedures are described in T. H. James, "The Theory of the Photographic Process", Fourth Edition, Macmillan Publishing Co. Inc., New York (1977), Chapter 5, pages 149 to 169.

The grain size of the silver halide particles can be determined by the Moeller Teller method in the sample containing silver halide particles is sedimented upon a filter paper, which is submerged in electrolyte together with a negative platinum needle-shaped electrode and a reference electrode. The silver halide particles on the filter paper are slowly scanned individually with the needle-shaped electrode, whereupon the silver halide grains are individually electrochemically reduced at the cathode. This electrochemical reduction is accompanied by a current pulse, which is registered as a function of time and integrated to give the charge transfer Q for the electrochemical reduction of the silver halide particle, which is proportional to its volume. From their volume the equivalent circular grain diameter of each grain can be determined and therefrom the average particle size and size distribution.

Substantially Light-Insensitive Organic Silver Salts

The substantially light-insensitive organic silver salt may be a silver salt of any organic acid including heterocyclic nitrogen compounds e.g. silver benzotriazolate or silver benzimidazolate, but is preferably a silver salt of an organic carboxylic acid having as its organic group: aryl, aralkyl, alkaryl or alkyl groups. Aliphatic carboxylic acids known as fatty acids, wherein the aliphatic carbon chain has at least 12 C-atoms, are preferred e.g. silver laurate, silver palmitate, silver stearate, silver hydroxystearate, silver oleate, silver behenate and silver arichidate, which silver salts are also called "silver soaps". Other silver salts of an organic carboxylic acid as described in GB-P 1,439,478, e.g. silver benzoate, and silver salts of organic carboxylic acids described in Research Disclosure 17029, but excluding silver salts of organic carboxylic acids substituted with a heterocyclic thione group as disclosed in Research Disclosure 12542 and U.S. Pat. No. 3,785,830, may likewise be used to produce a thermally developable silver image. Combinations of the substantially light-insensitive organic silver salts may also be used in the present invention.

According to a fourth embodiment of the photothermographic material with increased photosensitivity produced according to the process, according to the present invention, the substantially light-insensitive organic silver salt is a silver salt of an organic carboxylic acid.

According to a fifth embodiment of the photothermographic material with increased photosensitivity produced according to the process, according to the present invention, the substantially light-insensitive organic silver salt is a silver salt of an aliphatic carboxylic acid.

According to a sixth embodiment of the photothermographic material with increased photosensitivity produced according to the process, according to the present invention, the substantially light-insensitive organic silver salt is a silver salt of an aliphatic carboxylic acid with between 14 and 30 carbon atoms.

Aqueous dispersions of the substantially light-insensitive organic silver salts or mixtures thereof can be produced as described in U.S. Pat. No. 5,891,616 and EP-A 848286 and U.S. Pat. No. 3,839,049.

Water-Soluble Silver Salt

Whereas in convention photographic emulsions addition of a water-soluble silver salt to a dispersion of photosensitive silver halide prior to coating produces a photographic material with a very high fogging level, it has been surprisingly found that the addition of a silver salt with a water-solubility greater than 0.1 g/L water to an aqueous dispersion of a substantially light-insensitive and substantially water-insoluble organic silver salt and a photosensitive silver halide or a photosensitive agent generally produced an additional increase in photosensitivity of a photothermographic recording material comprising a photo-addressable thermally developable element comprising a layer produced by coating the aqueous dispersion onto a support, while having only a marginal effect on the background density of prints produced therewith.

The water-soluble silver salt in the aqueous dispersion of the present invention preferably has a solubility of greater than 0.1 g/L of water at 20° C., with a solubility greater than 1 g/L being preferred.

Suitable water-soluble silver salts according to the present invention include silver nitrate, silver acetate, silver propionate, silver sulfate, silver butyrate, silver isobutyrate, silver benzoate, silver tartrate, silver salicylate, silver malonate, silver succinate and silver lactate, with water-soluble silver salts selected from the group consisting of silver nitrate, silver acetate, silver lactate and silver sulfate being preferred. The solubilities of some of these salts are given below:

| | Solubility in water at 20° C. in g/L water |
|---|---|
| silver nitrate | 2150 |
| silver fluoride | 1800 (at 25° C.) |
| silver dithionate | 500 (at 16° C.) |
| silver acetate | 10.4 |
| silver propionate | 8.4 |
| silver sulfate | 7.7 (at 18° C.) |
| silver butyrate | 4.9 |
| silver metaphosphate | 3.2 |
| silver benzoate | 2.17 |
| silver tartrate | 2.01 (at 18° C.) |
| silver nitrite | 4.2 (at 25° C.) |
| silver selenate | 1.2 |
| silver salicylate | 0.8 (at 18° C.) |
| silver hyponitrite | 0.75 (at 13° C.) |
| silver malonate | 0.57 |
| silver tungstate | 0.5 (at 15° C.) |
| silver succinate | 0.18 (at 18° C.) |
| silver lactate | |

It is known in silver halide photography that addition of soluble silver salts to a dispersion of a silver halide produces an increase in UAg (=decrease in pAg=an increase in free silver ion concentration), which can result in partial reduction of the silver salts present, thereby producing metallic silver nuclei. Such metallic silver nuclei give rise to an increased fogging level in silver halide photographic materials. It is possible that an analogous effect is the basis for the sensitivity increase arising from the addition of water-soluble silver salt.

Organic Reducing Agents

Suitable organic reducing agents for the reduction of the substantially light-insensitive organic silver salt particles are organic compounds containing at least one active hydrogen atom linked to O, N or C, such as is the case with: aromatic di- and tri-hydroxy compounds; aminophenols; METOL™; p-phenylene-diamines; alkoxynaphthols, e.g. 4-methoxy-l-naphthol described in U.S. Pat. No. 3,094,41; pyrazolidin-3-one type reducing agents, e.g. PHENIDONE™: pyrazolin-5-ones; indan-1,3-dione derivatives; hydroxytetrone acids; hydroxytetronimides; hydroxylamine derivatives such as for example described in U.S. Pat. No. 4,082,901; hydrazine derivatives; and reductones e.g. ascorbic acid; see also U.S. Pat. Nos. 3,074,809, 3,080,254, 3,094,417 and 3,887,378. Particularly suitable reducing agents are sterically hindered phenols, bisphenols, sulfonamidophenols and those described in WO97/04357.

Combinations of reducing agents may also be used that on heating become reactive partners in the reduction of the substantially light-insensitive silver salt of an organic carboxylic acid. For example, combinations of sterically hindered phenols with sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents such as disclosed in U.S. Pat. No. 5,545,505, U.S. Pat. No. 5.545.507 and U.S. Pat. No. 5,558,983; acrylonitrile compounds as disclosed in U.S. Pat. No. 5,545,515 and U.S. Pat. No. 5,635,339; and 2-substituted malonodialdehyde compounds as disclosed in U.S. Pat. No. 5,654,130.

Binders for the Photo-Addressable Thermally Developable Element

The film-forming binder for use in the aqueous dispersion and photo-addressable thermally developable element of the present invention may a water-dispersible or a water-soluble binder.

Suitable water-soluble film-forming binders are: polyvinyl alcohol, polyacrylamide, polymethacrylamide, polyacrylic acid, polymethacrylic acid, polyethyleneglycol, polyvinylpyrrolidone, proteinaceous binders such as gelatine, modified gelatines such as phthaloyl gelatine, polysaccharides, such as starch, gum arabic and dextran and water-soluble cellulose derivatives.

Suitable water-dispersible binders are any water-insoluble polymers e.g. water-insoluble cellulose derivatives, polyurethanes, polyesters polycarbonates and polymers derived from α,β-ethylenically unsaturated compounds such as after-chlorinated polyvinyl chloride, partially hydrolyzed polyvinyl acetate, polyvinyl acetals, preferably polyvinyl butyral, and homopolymers and copolymers produced using monomers selected from the group consisting of: vinyl chloride, vinylidene chloride, acrylonitrile, acrylamides, methacrylamides. methacrylates, acrylates, methacrylic acid, acrylic acid, vinyl esters, styrenes, dienes and alkenes; or mixtures thereof.

Preferred water-dispersible binders are water-dispersible film-forming polymers with covalently bonded ionic groups selected from the group consisting of sulfonate, sulfinate, carboxylate, phosphate, quaternary ammonium, tertiary sulfonium and quaternary phosphonium groups. Further preferred water-dispersible binders are water-dispersible film-forming polymers with covalently bonded moieties with one or more acid groups.

It should be noted that there is no clear cut transition between a polymer dispersion and a polymer solution in the case of very small polymer particles resulting in the smallest particles of the polymer being dissolved and those slightly larger being in dispersion.

Water-dispersible binders with crosslinkable groups, e.g. epoxy groups, aceto-acetoxy groups and crosslinkable double bonds are also preferred. Preferred water-dispersible binders for use in the photo-addressable thermally developable element of the present invention are polymer latexes as disclosed in WO 97/04355.

The above mentioned binders or mixtures thereof may be used in conjunction with waxes or "heat solvents" also called "thermal solvents" or "thermosolvents" improving the reaction speed of the redox-reaction at elevated temperature.

Spectral Sensitizer

The photo-addressable thermally developable element of the photothermographic recording material, according to the present invention, optionally contains a spectral sensitizer, optionally together with a supersensitizer, to sensitize the photosensitive agent to the wavelength of the light source used, which may in the near UV, visible, e.g. 630 nm, 670 nm etc., or IR, parts of spectrum. The photosensitive agent may be spectrally sensitized with various known dyes including cyanine, merocyanine, styryl, hemicyanine, oxonol, hemioxonol and xanthene dyes optionally, particularly in the case of sensitization to infra-red radiation, in the presence of a so-called supersensitizer. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. In the above described cyanine and merocyanine dyes, those having imino groups or carboxyl groups are particularly effective.

The photothermographic recording material, according to the present invention, preferably contains a spectral sensitizer and particularly preferably a spectral sensitizer exclusive of a merocyanine dye containing a thione group.

The photo-addressable thermally developable element may also contain chemically sensitizing dye containing a thione group, which if it absorbs the wavelength of the light source used may also contribute to the spectral sensitization process.

Supersensitizers

The aqueous dispersion and photo-addressable thermally developable element, according to the present invention, may further include a supersensitizer. Preferred supersensitizers are selected from the group of compounds consisting of: mercapto-compounds, disulfide-compounds, stilbene compounds, organoborate compounds and styryl compounds.

Toning Agents

In order to obtain a neutral black image tone in the higher densities and neutral grey in the lower densities, the aqueous dispersion or photo-addressable thermally developable element according to the present invention may contain one or more toning agents. The toning agents should be in thermal working relationship with the substantially light-insensitive organic silver salt and reducing agents therefor during thermal processing.

Stabilizers and Antifoggants

In order to obtain improved shelf-life and reduced fogging, stabilizers and antifoggants such as phenyl tribromomethyl sulphone, 4-methyl phthalic acid and 2-mercapto-4-heptyl-oxadiazole may be incorporated into the aqueous dispersion and photo-addressable thermally developable elements according to the present invention.

Support

The support for the photothermographic recording material according to the present invention may be transparent, translucent or opaque and is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. The support may be in sheet, ribbon or web form. The support may be subbed with a subbing layer. It may also be made of an opacified resin composition.

Antihalation Dyes

The photothermographic recording materials used in the present invention may also contain antihalation or acutance dyes which absorb light which has passed through the photosensitive thermally developable photographic material, thereby preventing its reflection. Such dyes may be incorporated into the photo-addressable thermally developable element or in any other layer of the photothermographic material of the present invention.

Antistatic Layer

In a preferred embodiment the photothermographic recording material of the present invention an antistatic layer is applied to an outermost layer.

Surfactants and Dispersants

Surfactants are surface active agents which are soluble compounds which reduce the interfacial tension between a liquid and a solid. The thermographic and photothermographic recording materials of the present invention may contain anionic, non-ionic or amphoteric surfactants. Suitable dispersants are natural polymeric substances, synthetic polymeric substances and finely divided powders, for example finely divided non-metallic inorganic powders such as silica.

Coating

The coating of any layer of the photothermographic recording materials of the present invention may proceed by any coating technique e.g. such as described in Modern Coating and Drying Technology, edited by Edward D. Cohen and Edgar B. Gutoff, (1992) VCH Publishers Inc., 220 East 23rd Street, Suite 909 New York, N.Y. 10010, USA.

Photothermographic Printing

Photothermographic recording materials, according to the present invention, may be exposed with radiation of wavelength between an X-ray wavelength and a 5 microns wavelength with the image either being obtained by pixel-wise exposure with a finely focused light source, such as a CRT light source; a UV, visible or IR wavelength laser, such as a Violet-laser, a He/Ne-laser or an IR-laser diode, e.g. emitting at 400 nm, 630 nm, 650 nm, 780 nm, 830 nm or 850 nm; or a light emitting diode, for example one emitting at 659 nm; or by direct exposure to the object itself or an image therefrom with appropriate illumination e.g. with UV, visible or IR light.

For the thermal development of image-wise exposed photothermographic recording materials, according to the present invention, any sort of heat source can be used that enables the recording materials to be uniformly heated to the development temperature in a time acceptable for the application concerned e.g. contact heating, radiative heating, microwave heating etc.

Industrial Application

Photothermographic recording materials according to the present invention may be used for both the production of transparencies, for example in the medical diagnostic field in which black-imaged transparencies are widely used in inspection techniques operating with a light box, and reflection type prints, for example in the hard copy graphics field and in microfilm applications. For such applications the support will be transparent or opaque, i.e. having a white light reflecting aspect. Should a transparent base be used, the base may be colourless or coloured, e.g. with a blue colour for medical diagnostic applications.

The invention is described hereinafter by way of INVENTION EXAMPLES 1 to 50 and COMPARATIVE EXAMPLES 1 to 27 in which all percentages are percentages by weight unless otherwise specified and the following ingredients were used:

photo-addressable thermally developable element:

| | |
|---|---|
| AgB = | silver behenate |
| LOWINOX 22IB46 = | 2-propyl-bis(2-hydroxy-3,5-dimethylphenyl)methane from CHEM. WERKE LOWI; |
| R16875 = | R16875, a phthaloyl gelatine from ROUSSELOT; |
| K7598 = | type 7598, a calcium-free gelatin from AGFA-GEVAERT GELATINEFABRIEK; |
| Surfactant Nr. 1 = | MARLON A-396, a sodium alkyl-phenylsulfonate from Hüls; |
| Surfactant Nr. 2 = | ERKANTOL ™ BX, a sodium diisopropyl-naphthalenesulfonate from BAYER; |
| Surfactant Nr. 3 = | ULTRAVON ™ W, supplied as a 75–85% concentrate of a sodium arylsulfonate by CIBA-GEIGY; |
| Surfactant Nr. 4 = | AKYPO ™ OP-80, a sodium salt of octylphenoxy-polyethoxy-acetic acid from CHEMY; |
| TA01 = | phthalazine; |
| STABI 01 = | 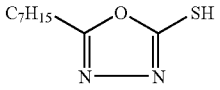 |
| STABI 02 = | 4-methyl-phthalic acid; and |
| STABI 03 = | phenyl tribromomethyl sulfone. |

NCSA01

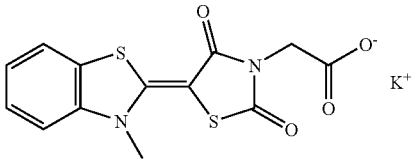

NCSA02

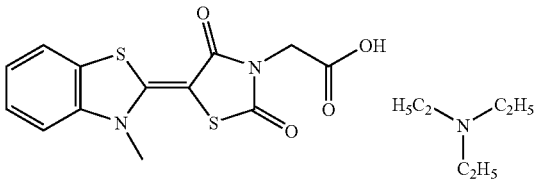

NCSA03

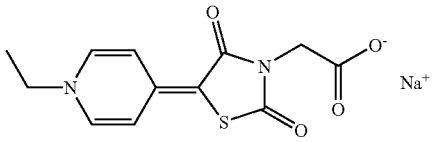

NCSA04

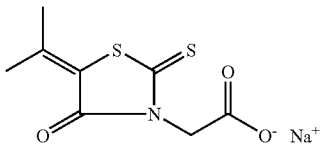

NCSA05

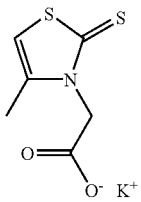

NCSA06

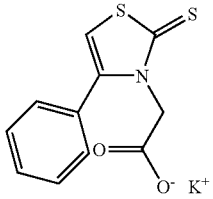

-continued
NCSA07
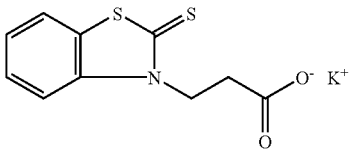
NCSA08
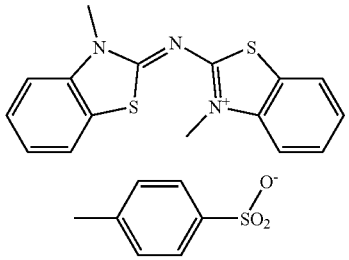
NCSA09
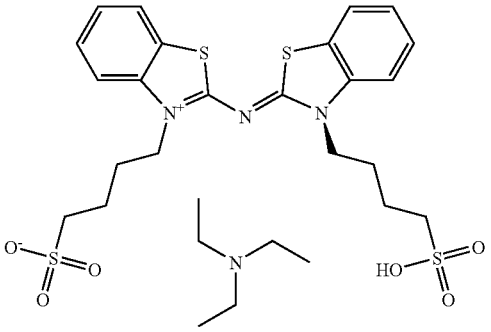
NCSA10
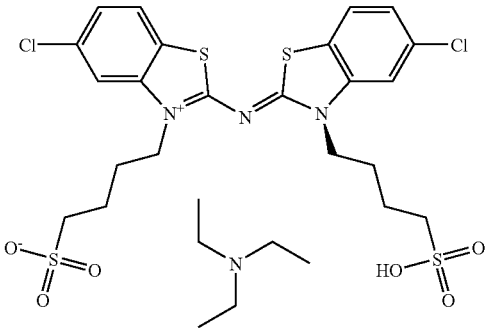
NCSA11
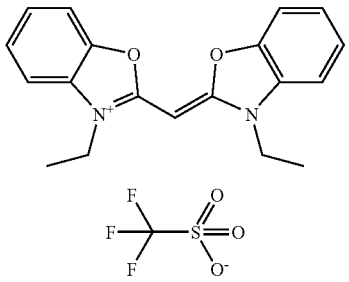
NCSA12
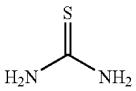

-continued

| | |
|---|---|
| NCSA13 | 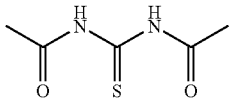 |
| NCSA14 = protective layer: | $Na_2S_2O_3$ |
| K7598 = | Type 7598, a calcium-free gelatin from AGFA-GEVAERT GELATINEFABRIEK; and, |
| Surfactant Nr. 5 = | ammonium salt of perfluoro-octanoic acid. |

INVENTION EXAMPLES 1 TO 16 AND COMPARATIVE EXAMPLES 1 AND 2

Preparation of the Photosensitive Silver Halide

The silver halide emulsion consisting of 11.44% by weight of silver bromide particles with a weight average particle size of 78 nm as measured with the Moeller Teller method (see above for details) and 5.17% by weight of R16875 as dispersing agent in deionized water was prepared using conventional silver halide preparation techniques at 48° C. such as described, for example, in T. H. James, "The Theory of the Photographic Process, Fourth Edition, Macmillan Publishing Co. Inc., New York (1977)", Chapter 3, pages 88–104.

Preparation of Silver Behenate Dispersions in an Aqueous Medium in the Absence of Organic Solvent using the Single Jet Process Disclosed in EP-A 848 286:

The aqueous dispersion of silver behenate used in INVENTION EXAMPLES 1 to 16 and COMPARATIVE EXAMPLES 1 and 2 was produced as follows:

i) dispersing 136.2 g (0.4M) behenic acid with stirring at 310 rpm with a 80 mm diameter typhoon stirrer in a 200 mm in diameter vessel at 80° C. in a quantity of 0.549 L of a 10% solution of Surfactant nr 1 and 662 g of deionized water at a temperature of 80° C.;

ii) then adding 0.188 L of a 2M aqueous solution of sodium hydroxide with stirring at 310 rpm with a 80 mm diameter typhoon stirrer to the 200 mm in diameter vessel at 80° C. over a period of 10 minutes to produce a clear solution substantially containing sodium behenate;

iii) then adding a 0.360 L of a 1M aqueous solution of silver nitrate with stirring at 310 rpm with a 80 mm diameter typhoon stirrer to the 200 mm in diameter vessel at a temperature of 80° C. over a period of 4.5 minutes to convert the sodium behenate completely into silver behenate.

The aqueous silver behenate dispersion obtained contained 8.15% by weight of silver behenate and 2.78% by weight of Surfactant 1 and was subsequently desalted and concentrated using ultrafiltration to an aqueous dispersion containing 22.10% by weight of silver behenate.

Preparation of Aqueous Dispersions 28.7 g of K7598 was dissolved in 150 g of deionized water at 40° C. and to this solution were added the following ingredients in the following steps:

Step 1: 19.35 g of a 11.44% by weight dispersion of silver bromide was added over a period of 20 s with stirring corresponding to 11.7 mmol of silver bromide.

Step 2: 10.8 g of a 7.12% by weight of a silver nitrate solution was added.

Step 3: 2259 of the above-described silver behenate dispersion was added together with 2.6 g of 1N nitric acid and 13 g of a 4.71% by weight of a solution of Surfactant Nr. 4.

Step 4: 6.4 g of a 8% by weight solution in methanol of STABI 01 was added.

Step 5: 62.49 of a dispersion consisting of 9.48% by weight of phthalazine, 34.05% by weight of LOWINOX 22IB46 and 4% by weight of Surfactant Nr. 2 was added just before coating.

The chemically sensitizing merocyanine dye (CSMD) was added at one or more of four points in the preparation process denoted by A, B, C and D:

A denotes addition of the chemically sensitizing merocyanine dye between steps 1 and 2;

B denotes addition of the chemically sensitizing merocyanine dye between steps 2 and 3;

C denotes addition of the chemically sensitizing merocyanine dye between steps 3 and 4;

D denotes addition of the chemically sensitizing merocyanine dye between steps 1 and 3 with step 2 omitted.

In each case the chemically sensitizing merocyanine dye was added as a 4 g/L aqueous solution and the dispersion was stirred for 20 minutes at 40° C. after addition of the solution of chemically sensitizing merocyanine dye.

Preparation of the Photothermographic Recording Materials

The solution for the first layer of the photo-addressable thermally developable element was prepared by dissolving 46.7 g of K7598 in 1500 g of deionized water at 40° C. and then adding the following ingredients with stirring: 9.6 g of STABI 02, 197 g of an aqueous dispersion of STABI 03 (consisting of 17.5% by weight of STABI 03, 10% by weight of K7598 and 1% by weight of Surfactant Nr. 1), 6.6 g of 1-phenyl-5-mercapto-tetrazole dissolved in 250 g of methanol and 19.1 g of a 10% by weight aqueous solution of Surfactant Nr. 3. The resulting dispersion was made up to 2650 g with deionized water.

One side of a subbed 100 μm poly(ethylene terephthalate) support was then coated with the solution for the first layer of the photo-addressable thermally developable element to a wet layer thickness of 50 μm to produce after drying at 25° C. for 5 minutes the first layer of the thermosensitive element.

The first layer of the photo-addressable thermally developable element was then overcoated with the above-described aqueous dispersion to a wet layer thickness of 100 μm to form after drying at 25° C. for 5 minutes the second layer of the thermosensitive element.

Finally the second layer of the photo-addressable thermally developable element was overcoated with a solution of 57 g of K7598 in 2560 g of deionized water to which 78 g of a 5% by weight solution of Surfactant Nr. 5 had been added to a wet layer thickness of 50 μm to form after drying at 25° C. for 5 minutes a protective layer.

Evaluation of the Photothermographic Recording Materials

The photothermographic recording materials of INVENTIVE EXAMPLES 1 to 16 and COMPARATIVE EXAMPLES 1 AND 2 were first exposed to a diode laser (400 nm wavelength) through a grey scale wedge to vary the exposure of the film and then heated for 20 s at 100° C. to produce a wedge image. The print density variation in the wedge image was determined with a MACBETH TD903 densitometer with a visual filter giving the dependence of optical density upon exposure. The SENSITIVITY S-values, defined as the exposure in mJ/m$^2$ at which an optical density of 1.0 above Dmin was achieved, were determined from these optical density-exposure dependencies. The lower the value of exposure, S, required to obtain an optical density of 1.0 above Dmin, the higher the photosensitivity of the photothermographic material.

The results for the photothermographic recording materials of INVENTION EXAMPLES 1 to 16 and COMPARATIVE EXAMPLES 1 and 2 are summarized in Table 1 below.

The photothermographic recording materials of INVENTION EXAMPLES 1 to 16 were prepared with different concentration of CSMD01, added in different order during the preparation of the aqueous dispersion (A, B or C), and they all exhibited a significant reduction in S-values compared with the S-value of 125.9 mJ/m$^2$ of the photothermographic recording material of COMPARATIVE EXAMPLE 1 wherein the addition of the chemically sensitizing merocyanine dye was omitted.

In the photothermographic recording material of COMPARATIVE EXAMPLE 2 NCSA01, a dye not containing a thione-group, was added instead of CSMD01 and this material exhibited a higher S-value, indicating a lower photographic sensitivity than those of INVENTION EXAMPLES 1 to 16.

TABLE 1

| | Type CSMD or NCSA | CSMD or NCSA added [mmoles] | mmol CSMD or NCSA/ mol AgX | Order of addition of CSMD or NCSA | Sensitivity S [mJ/m$^2$] |
|---|---|---|---|---|---|
| | | Invention Example nr | | | |
| 1 | CSMD01 | 58.5 | 5.0 | A | 11.2 |
| 2 | CSMD01 | 117 | 10.0 | A | 6.3 |
| 3 | CSMD01 | 175.5 | 15.0 | A | 8.9 |
| 4 | CSMD01 | 234 | 20.0 | A | 8.9 |
| 5 | CSMD01 | 351 | 30.0 | A | 11.2 |
| 6 | CSMD01 | 468 | 40.0 | A | 14.1 |
| 7 | CSMD01 | 58.5 | 5.0 | B | 12.6 |
| 8 | CSMD01 | 117 | 10.0 | B | 7.9 |
| 9 | CSMD01 | 23.4 | 2.0 | C | 28.2 |
| 10 | CSMD01 | 58.5 | 5.0 | C | 11.2 |
| 11 | CSMD01 | 85.4 | 7.3 | C | 11.2 |
| 12 | CSMD01 | 117 | 10.0 | C | 17.8 |
| 13 | CSMD01 | 175.5 | 15.0 | C | 14.8 |
| 14 | CSMD01 | 234 | 20.0 | C | 21.4 |
| 15 | CSMD01 | 58.5 | 5.0 | A | 7.9 |
| | CSMD01 | 58.5 | 5.0 | B | |
| 16 | CSMD01 | 29.25 | 2.5 | A | 11.2 |
| | CSMD01 | 29.25 | 2.5 | B | |
| | CSMD01 | 29.25 | 2.5 | C | |
| | | Comparative Example nr | | | |
| 1 | — | — | — | — | 125.9 |
| 2 | NCSA01 | 58.5 | 5.0 | C | 125.8 |

INVENTION EXAMPLE 17 AND COMPARATIVE EXAMPLE 3

The preparation of the photothermographic recording materials of INVENTION EXAMPLE 17 and COMPARATIVE EXAMPLE 3 was carried out in the same way as that for INVENTION EXAMPLE 2 and COMPARATIVE EXAMPLE 1 except that step 2 was omitted i.e. no silver nitrate solution was added. The chemically sensitizing merocyanine dye was added between steps 1 and 3, denoted by D.

The results for the photothermographic recording materials of INVENTION EXAMPLE 17 and COMPARATIVE EXAMPLE 3 are summarized in Table 2 below.

TABLE 2

| | Type CSMD or NCSA | CSMD or NCSA added [mmoles] | mmol CSMD or NCSA/ mol AgX | Order of addition of CSMD or NCSA | Sensitivity S [mJ/m$^2$] |
|---|---|---|---|---|---|
| | | Invention Example nr | | | |
| 17 | CSMD01 | 117 | 10.0 | D | 11.2 |
| | | Comparative Example nr | | | |
| 3 | — | — | — | — | >300 |

The photothermographic recording material of INVENTION EXAMPLE 17, carried out without adding silver nitrate, exhibited a significant reduction in the S-value compared with that of COMPARATIVE EXAMPLE 3 in which no CSMD01 and no silver nitrate were added. However, the exposure necessary to obtain an increase in optical density of 1.0 was higher in the case of the photothermographic recording material of INVENTION EXAMPLE 17 in which no silver nitrate was added than those for the photothermographic recording materials of in the cases of INVENTION EXAMPLES 2 and 8 in which the same chemically sensitizing merocyanine dye, CSMD01, was added at analogous stages of the preparation procedure. However, the exposure to obtain an increase in optical density of 1.0 was lower in the case of the photothermographic recording material of INVENTION EXAMPLE 17 than for the photothermographic recording material of INVENTION EXAMPLE 12 in which the same chemically sensitizing merocyanine dye was added in the same quantity but at a non-analogous point, point C, in the preparation process and step 2 was carried out.

Therefore the effect of the added silver nitrate upon the photosensitivity of the photothermographic recording material is dependent upon the point in the preparation process at which the chemically sensitizing merocyanine dye was added.

INVENTION EXAMPLES 18 TO 20 AND COMPARATIVE EXAMPLE 4

The preparation of the photothermographic recording materials of INVENTION EXAMPLES 18 to 20 was carried out in the same way as INVENTION EXAMPLES 9 to 14 with the exception that CSMD01 was replaced by the CSMD02. The preparation of the photothermographic recording material of COMPARATIVE EXAMPLE 4 was carried out in the same way as COMPARATIVE EXAMPLE 2 with the exception that NCSA01 was replaced by NCSA02.

The results for the photothermographic recording materials of INVENTION EXAMPLES 18 to 20 and COMPARATIVE EXAMPLE 4 are summarized in Table 3 below.

TABLE 3

| | Type CSMD or NCSA | CSMD or NCSA added [mmoles] | mmol CSMD or NCSA/ mol AgX | Order of addition of CSMD or NCSA | Sensitivity S [mJ/m$^2$] |
|---|---|---|---|---|---|
| | | Invention Example nr | | | |
| 18 | CSMD02 | 29.25 | 2.5 | C | 21.4 |
| 19 | CSMD02 | 58.5 | 5.0 | C | 15.8 |
| 20 | CSMD02 | 85.4 | 7.3 | C | 12.6 |
| | | Comparative Example nr | | | |
| 4 | NCSA02 | 58.5 | 5.0 | C | 125.9 |

The photothermographic recording materials of INVENTION EXAMPLES 18 to 20 were carried out with different amounts of CSMD02, which dye has a different counter ion (the acid salt with tri-ethyl-amine) than CSMD01 (the potassium-salt), and they all exhibited a significant reduction in S-values compared with the S-value of the photothermographic recording material of COMPARATIVE EXAMPLE 4 wherein NCSA02 was used, a merocyanine dye not containing a thione-group, and this material exhibited a higher S-value, indicating a lower photothermographic sensitivity than the INVENTION EXAMPLES 18 to 20.

INVENTION EXAMPLE 21 TO 26 AND COMPARATIVE EXAMPLE 5

The preparation of the photothermographic recording materials of INVENTION EXAMPLES 11 to 26 were carried out in the same way as INVENTION EXAMPLES 1 to 14 with the exception that CSMD01 was replaced by CSMD03. The preparation of the photothermographic recording material of COMPARATIVE EXAMPLE 5 was carried out in the same way as COMPARATIVE EXAMPLE 2 with the exception that NCSA01 was replaced by NCSA03, a merocyanine dye not containing a thione group.

The results for the photothermographic recording materials of INVENTION EXAMPLES 21 to 26 and COMPARATIVE EXAMPLE 5 are summarized in Table 4 below.

TABLE 4

| | Type CSMD or NCSA | CSMD or NCSA added [mmoles] | mmol CSMD or NCSA/ mol AgX | Order of addition of CSMD or NCSA | Sensitivity S [mJ/m$^2$] |
|---|---|---|---|---|---|
| | | Invention Example nr | | | |
| 21 | CSMD03 | 29.25 | 2.5 | C | 56.2 |
| 22 | CSMD03 | 58.5 | 5.0 | C | 28.2 |
| 23 | CSMD03 | 85.4 | 7.3 | C | 30.2 |
| 24 | CSMD03 | 117 | 10.0 | A | 15.8 |
| 25 | CSMD03 | 234 | 20.0 | A | 25.1 |
| 26 | CSMD03 | 351 | 30.0 | A | 25.1 |
| | | Comparative Example nr | | | |
| 5 | NCSA03 | 58.5 | 5.0 | C | 158.5 |

The photothermographic recording materials of INVENTION EXAMPLES 21 to 26 were prepared with different amounts of CSMD03, added in different order during the preparation of the aqueous dispersion (A or C), and they all exhibited a significant reduction in S-values compared with the S-value of the photothermographic recording material of COMPARATIVE EXAMPLE 5 wherein NCSA03, a merocyanine dye not containing a thione-group, was used and this material exhibited a higher S-value, indicating a lower photothermographic sensitivity than those of the photothermographic recording materials of INVENTION EXAMPLES 21 to 26.

INVENTION EXAMPLES 27 TO 31

The preparation of the photothermographic materials of INVENTION EXAMPLES 27 to 31 was carried out in the same way as that for the photothermographic recording materials of INVENTION EXAMPLES 9 to 14 with the exception that CSMD01 was replaced by CSMD04. The results for the photothermographic recording materials of INVENTION EXAMPLES 27 to 31 are summarized in Table 5 below.

The photothermographic recording materials of INVENTION EXAMPLES 27 to 31 prepared with different amounts of CSMD04, all exhibited a significant reduction in S-value compared with the S-value of the photothermographic recording material of COMPARATIVE EXAMPLE 1, and these low values indicate a higher photothermographic sensitivity for the INVENTION EXAMPLES 27 to 31.

TABLE 5

| | Type CSMD or NCSA | CSMD or NCSA added [mmoles] | mmol CSMD or NCSA/ mol AgX | Order of addition of CSMD or NCSA | Sensitivity S [mJ/m$^2$] |
|---|---|---|---|---|---|
| | | Invention Example nr | | | |
| 27 | CSMD04 | 58.5 | 5.0 | C | 44.7 |
| 28 | CSMD04 | 87.75 | 7.5 | C | 35.5 |
| 29 | CSMD04 | 117 | 10.0 | C | 50.1 |
| 30 | CSMD04 | 175.5 | 15.0 | C | 50.1 |
| 31 | CSMD04 | 234 | 20.0 | C | 53.7 |

INVENTION EXAMPLES 32 TO 34

The preparation of the photothermographic recording materials of INVENTION EXAMPLES 32 to 34 was carried out in the same way as that for the photothermographic recording materials of INVENTION EXAMPLES 9 to 14 with the exception that CSMD01 was replaced by CSMD05. The results for the photothermographic recording materials of INVENTION EXAMPLES 32 to 34 are summarized in Table 6 below.

TABLE 6

| | Type CSMD or NCSA | CSMD or NCSA added [mmoles] | mmol CSMD or NCSA/ mol AgX | Order of addition of CSMD or NCSA | Sensitivity S [mJ/m$^2$] |
|---|---|---|---|---|---|
| | | Invention Example nr | | | |
| 32 | CSMD05 | 29.25 | 2.5 | C | 44.7 |
| 33 | CSMD05 | 58.5 | 5.0 | C | 39.8 |
| 34 | CSMD05 | 87.75 | 7.5 | C | 35.5 |

The photothermographic recording materials of INVENTION EXAMPLES 32 to 34 prepared with different amounts of CSMD05 all exhibited a significant, reduction in S-value compared with the S-value of the photothermographic recording material of COMPARATIVE EXAMPLE 1, and these low values indicate a higher photothermographic sensitivity for the photothermographic recording materials of INVENTION EXAMPLES 32 to 34.

INVENTION EXAMPLES 35 TO 44

The preparation of the photothermographic recording materials of INVENTION EXAMPLES 35, 37, 39 and 41 to 44 was carried out in the same way as that for the photothermographic recording material of INVENTION EXAMPLE 10 with the exception that CSMD01 was replaced by CSMD06, CSMD07 and CSMD08 as indicated in Table 7.

The preparation of the photothermographic recording materials of INVENTIVE EXAMPLES 36, 38 and 40 was carried out in the same way as that for the photothermographic recording material of INVENTION EXAMPLE 1 with the exception that CSMD01 was replaced by CSMD06, CSMD07 and CSMD08, and with the exception that in the order of addition the same CSMD was added at position A and B, during the preparation of the aqueous dispersion.

The results for the photothermographic recording materials of INVENTION EXAMPLES 35 to 44 and COMPARATIVE EXAMPLE 6 are summarized in Table 7 below.

The photothermographic recording materials of INVENTION EXAMPLE 35 to 44 were prepared with CSMD06, CSMD07 and CSMD08, and during the preparation of the aqueous dispersion the same CSMD was added before and after adding the silver nitrate solution (A and B). They all exhibited a low S-value, indicating a high photothermographic sensitivity.

COMPARATIVE EXAMPLES 6 to 27

The preparation of the photothermographic recording materials of COMPARATIVE EXAMPLES 6 to 26 was carried out in the same way as that for the photothermographic recording material of INVENTION EXAMPLE 1 with the exception that CSMD01 was replaced by NCSA04, NCSA05, NCSA06, NCSA07, NCSA08, NCSA09, NCSA10, NCSA11, NCSA12, NCSA13 or NCSA14 respectively.

The preparation of the photothermographic recording material of COMPARATIVE EXAMPLE 27 was carried out in the same way as that for the photothermographic recording material of INVENTION EXAMPLE 1 with the exception that CSMD01 was replaced by NCSA14 and with the except that step 2 was omitted i.e. no silver nitrate was added.

The results for the photothermographic recording materials of the COMPARATIVE EXAMPLES 6 to 27 are summarized in Table 8 below.

TABLE 7

| | Type CSMD or NCSA | CSMD or NCSA added [mmoles] | mmol CSMD or NCSA/ mol AgX | Order of addition of CSMD or NCSA | Sensitivity S [mJ/m$^2$] |
|---|---|---|---|---|---|
| | | Invention Example nr | | | |
| 35 | CSMD06 | 58.5 | 5 | C | 17.8 |
| 36 | CSMD06 | 58.5 | 5 | A | 14.1 |
| | CSMD06 | 58.5 | 5 | B | |
| 37 | CSMD07 | 58.5 | 5 | C | 20.0 |
| 38 | C5MD07 | 58.5 | 5 | A | 24.0 |
| | CSMD07 | 58.5 | 5 | B | |
| 39 | CSMD08 | 58.5 | 5 | C | 17.8 |
| 40 | CSMD08 | 58.5 | 5 | A | 12.6 |
| | CSMD08 | 58.5 | 5 | B | |
| 41 | CSMD09 | 58.5 | 5 | C | 35.5 |
| 42 | CSMD10 | 58.5 | 5 | C | 39.8 |
| 43 | CSMD11 | 58.5 | 5 | C | 70.8 |
| 44 | CSMD12 | 58.5 | 5 | C | 70.8 |

TABLE 8

| | Type CSMD or NCSA | CSMD or NCSA added [mmoles] | mmol CSMD or NCSA/ mol AgX | Order of addition of CSMD or NCSA | Sensitivity S [mJ/m$^2$] |
|---|---|---|---|---|---|
| | | Comparative Example nr | | | |
| 6 | NCSA04 | 58.5 | 5 | A | 281.8 |
| 7 | NCSA05 | 87.75 | 7.5 | A | 125.3 |
| 8 | NCSA05 | 58.5 | 5 | A | 125.2 |
| 9 | NCSA05 | 29.25 | 2.5 | A | 120 |
| 10 | NCSA06 | 87.75 | 7.5 | A | 120 |
| 11 | NCSA06 | 58.5 | 5 | A | 125.2 |
| 12 | NCSA06 | 29.25 | 2.5 | A | 120 |
| 13 | NCSA07 | 87.75 | 7.5 | A | 122.8 |
| 14 | NCSA07 | 58.5 | 5 | A | 125.5 |
| 15 | NCSA07 | 29.25 | 2.5 | A | 122.8 |
| 16 | NCSA08 | 58.5 | 5 | A | 125.8 |
| 17 | NCSA09 | 58.5 | 5 | A | 151.2 |
| 18 | NCSA10 | 58.5 | 5 | A | 122.2 |
| 19 | NCSA11 | 58.5 | 5 | A | 151.2 |
| 20 | NCSA12 | 87.75 | 7.5 | A | * |
| 21 | NCSA12 | 58.5 | 5 | A | * |
| 22 | NCSA12 | 29.25 | 2.5 | A | * |
| 23 | NCSA13 | 87.75 | 7.5 | A | * |
| 24 | NCSA13 | 58.5 | 5 | A | * |
| 25 | NCSA13 | 29.25 | 2.5 | A | * |
| 26 | NCSA14 | 23.4 | 2 | A | * |
| 27 | NCSA14 | 23.4 | 2 | A | * |

The photothermographic recording materials of the COMPARATIVE EXAMPLES 6 to 15 were prepared with NCSA04, NCSA05, NCSA06 and NCSA07. These compounds are not merocyanine dyes, but do contain a thione group. The photothermographic recording materials of these COMPARATIVE EXAMPLES exhibited a high S-value, indicating a low photothermographic sensitivity.

The photothermographic recording materials of the COMPARATIVE EXAMPLES 16 to 19 were prepared with NCSA08, NCSA09, NCSA10 and NCSA11, cyanine dyes not containing a thione group (only a thioether or an ether group). The photothermographic recording materials of these COMPARATIVE EXAMPLES exhibited a high S-value, indicating a low photothermographic sensitivity.

The photothermographic recording materials of COMPARATIVE EXAMPLES 20 to 27 were prepared with NCSA12, NCSA13 and NCSA14, which are not dyes and do not contain a thione group, but do contain a labile sulfur-atom and are useful in the chemical sensitization of silver halide in conventional silver halide emulsion materials. The photothermographic recording material of COMPARATIVE EXAMPLE 27 was prepared with NCSA14, but step 2 was omitted i.e. no silver nitrate was added. The photothermographic recording materials of these COMPARATIVE EXAMPLES exhibited a very high fog level, as indicated in Table 8 by an asterisk, so that further evaluation of the photographic sensitivity was not relevant.

INVENTION EXAMPLES 45 TO 50

The preparation of the photothermographic recording materials of INVENTIVE EXAMPLES 45 and 46 was carried out in the same way as that for the photothermographic recording material of INVENTION EXAMPLE 36 with the exception that different CSMD-types were added in different amounts and at different positions during the preparation of the aqueous dispersion as indicated in Table 9.

The preparation of the photothermographic recording materials of INVENTIVE EXAMPLES 47 to 50 was carried out in the same way as that for the photothermographic recording material of INVENTION EXAMPLE 12 with the exception that different CSMD-types were mixed in different amounts, and this mixture was added during the preparation of the aqueous dispersion as indicated in Table 9. The results for the photographic recording materials of INVENTION EXAMPLES 45 to 50 are summarized in Table 9 below.

The photothermographic recording materials of INVENTION EXAMPLES 45 to 50 were prepared with different combinations CSMD01, CSMD03, CSMD04 and CSMD05, added in a different order or added as a mixture of different CSMD-types during the preparation of the aqueous dispersion. These materials exhibited a low S-value, indicating a high photothermographic sensitivity.

TABLE 9

| | Type CSMD or NCSA | CSMD or NCSA added [mmoles] | mmol CSMD or NCSA/ mol AgX | Order of addition of CSMD or NCSA | Sensitivity S [mJ/m$^2$] |
|---|---|---|---|---|---|
| | | Invention Example nr | | | |
| 45 | CSMD03 | 29.25 | 2.5 | A | 12.6 |
| | CSMD01 | 58.5 | 5.0 | B | |
| 46 | CSMD01 | 58.5 | 5.0 | A | 12.0 |
| | CSMD03 | 29.25 | 2.5 | B | |
| 47 | CSMD01 | 58.5 | 5.0 | C | 15.8 |

TABLE 9-continued

| | Type CSMD or NCSA | CSMD or NCSA added [mmoles] | mmol CSMD or NCSA/ mol AgX | Order of addition of CSMD or NCSA | Sensitivity S [mJ/m$^2$] |
|---|---|---|---|---|---|
| | CSMD03 | 58.5 | 5.0 | | |
| 48 | CSMD01 | 58.5 | 5.0 | C | 15.8 |
| | CSMD04 | 58.5 | 5.0 | | |
| 49 | CSMD03 | 58.5 | 5.0 | C | 28.2 |
| | CSMD04 | 58.5 | 5.0 | | |
| 50 | CSMD01 | 58.5 | 5.0 | C | 15.8 |
| | CSMD05 | 58.5 | 5.0 | | |

The present invention may include any feature or combination of features disclosed herein either implicitly or explicitly or any generalisation thereof irrespective of whether it relates to the presently claimed invention. In view of the foregoing description it will be evident to a person skilled in the art that various modifications may be made within the scope of the invention.

What is claimed is:

1. A process for preparing a photothermographic material with increased photosensitivity, said photothermographic material comprising a support and a photo-addressable thermally developable element, exclusive of a compound R-S $(M)_n$ wherein R is an aliphatic hydrocarbon, aryl or heterocyclic group, M is a hydrogen atom, or cation, and letter n is a number determined so as to render the molecule neutral and also exclusive of a compound capable of releasing a mobile dye corresponding to or inversely corresponding to the reduction of silver halide to silver at elevated temperatures, said photo-addressable thermally developable element containing a light-insensitive organic silver salt, a photosensitive agent in catalytic association with said light-insensitive organic silver salt, a reducing agent for said light-insensitive organic silver salt in thermal working relationship therewith, a silver salt having a water-solubility greater than 0.1 g in 1 L water at 20° C. and a binder, comprising the steps of:

(i) increasing the photosensitivity of a photosensitive silver halide by chemical sensitisation with a chemical sensitising merocyanine dye containing a thione group in a non-oxidative aqueous medium, optionally in the presence of said light-insensitive organic silver salt and/or in the presence of said silver salt having a water-solubility greater than 0.1 g in 1 L water at 20° C., thereby preparing said photosensitive agent;

(ii) coating said support with one or more aqueous solutions or dispersions together containing said light-insensitive organic silver salt, said photosensitive agent, said reducing agent, said silver salt having a water-solubility greater than 0.1 g in 1 L water at 20° C. and said binder; and (iii) drying said coating or coatings thereby producing said photo-addressable thermally developable element.

2. The process according to claim 1, wherein said chemically sensitizing merocyanine dye is capable of spectrally sensitizing said photosensitive silver halide.

3. The process according to claim 1, wherein said chemically sensitizing merocyanine dye comprises a rhodanine ring, a thiohydantoin ring, a thiobarbituric acid ring or a 2-thio-4-oxo-oxazolidine ring, optionally substituted with alkyl, substituted alkyl, aryl, substituted aryl, arylalkyl, substituted arylalkyl, heteroaryl, or substituted heteroaryl.

4. The process according to claim 1, wherein said chemically sensitizing merocyanine dye comprising formula (I) or (II) or (III) wherein (I) =

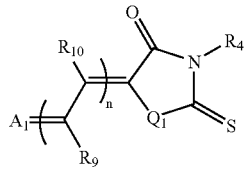

(II) =

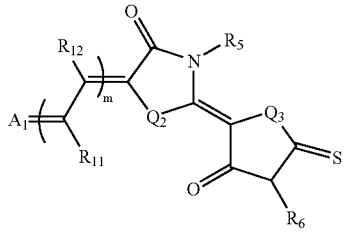

(III) =

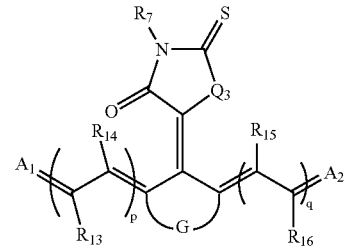

wherein $A_1$ and $A_2$ are each independently selected from one of the following structures:

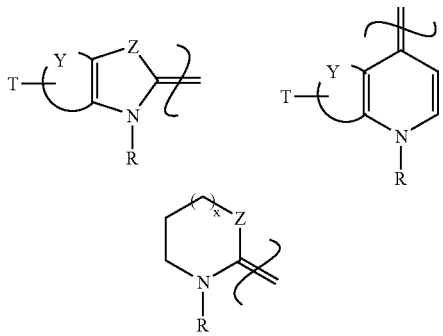

R selected from alkyl, substituted alkyl, arylalkyl, and substituted arylalkyl; $Q_1$, $Q_2$ and $Q_3$ are independently selected from —O—, —S—, —$NR_1$—, and —CO—$NR_2$—; $R_1$ is selected from alkyl, substituted alkyl, aryl, substituted aryl, heteroaryl, and substituted heteroaryl; $R_2$ is selected from —H, alkyl, and substituted alkyl; $R_3$ is selected from alkyl; and substituted alkyl; $R_4$ to $R_7$ are each independently selected from alkyl, substituted alkyl, aryl, substituted aryl, arylalkyl, substituted arylalkyl, heteroaryl and substituted heteroaryl; $R_9$ to $R_{16}$ are each independently selected from —H, methyl, ethyl, isopropyl, phenyl, substituted phenyl, benzyl, substituted benzyl, cyclopropyl, and —$(CH_2)_2$—COOH or salts; n, m, p and q are each independently 0, 1, 2 or 3; x is 0 or 1; Z is selected from —O—, —S—, —$NR_1$—, —CH═CH—, and —$C(CH_3)_2$—; G represents the atoms necessary to complete a carbocyclic ring or a heterocyclic ring; Y represents the atoms necessary to complete a carbocyclic ring or a heterocyclic ring; T is selected from alkyl, —Cl, —Br, —I, alkoxy, metboxy, ethoxy, hydroxy, —S—$CH_3$, phenyl, substituted phenyl, annulated benzo-ring, 1-indolyl, 1-pyrrolyl, 2-pyrrolyl 3-pyrrolyl, 2-thienyl, 3-thienyl, 2-furyl, 3-furyl, —NH—CO—$R_{17}$, —CO—$NHR_{17}$, —NH—CO—NHR17, —NH—$SO_2$—$NHR_{17}$, —CN, —$CF_3$, —$SO_2$—$CF_3$, —$SO_2$—$CH_3$, —$SO_2$—$NR_2R_3$, —$CO_2$—$R_2$, and —CO—$NR_2R_2$; and $R_{17}$ is selected from an alkyl containing 1 to 6 carbon atoms, 2-furyl, and 2-thienyl.

5. The process according to claim 1, wherein said chemically sensitizing merocyanine dye or dyes selected from the group consisting of:

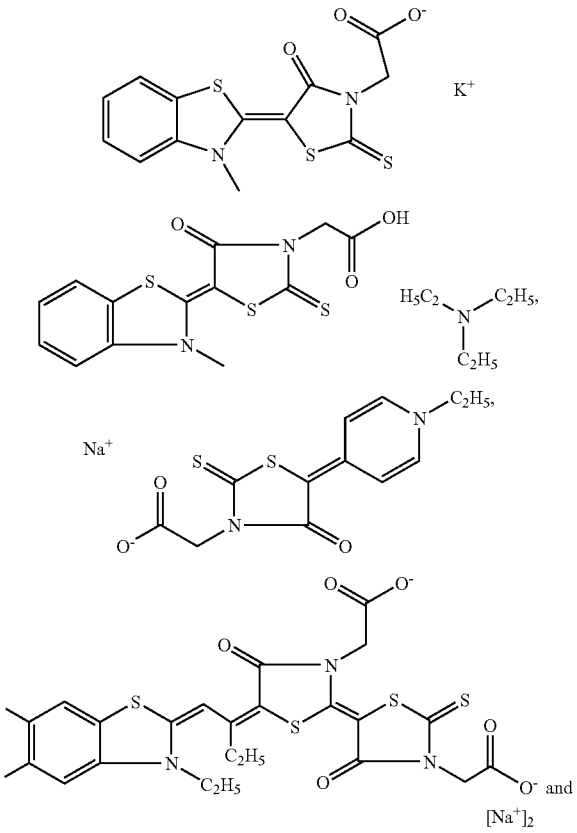

-continued

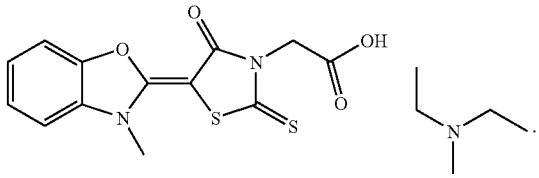

6. The process according to claim 1, wherein said photosensitive silver halide is chemically sensitised with at least two of said chemical sensitising merocyanine dyes containing a thione group in a non-oxidative aqueous medium.

7. The process according to claim 1, wherein said chemically sensitizing merocyanine dye comprising formula (I) or (II) or (III) wherein (I)=

(I) =

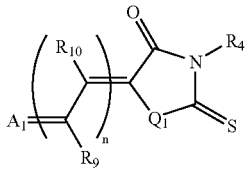

(II) =

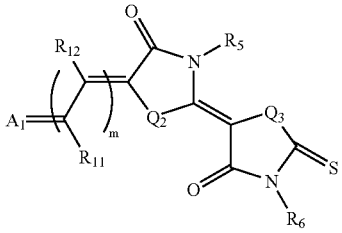

(III) =

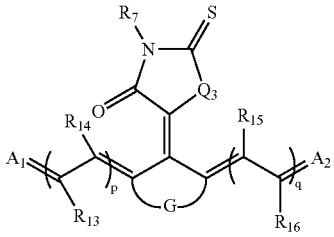

wherein $A_1$ and $A_2$ are each independently selected from one of the following structures:

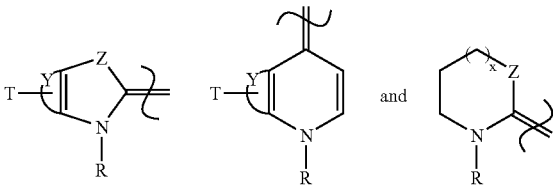

R is selected from alkyl, substituted alkyl, arylalkyl, and substituted arylalkyl; $Q_1$, $Q_2$ and $Q_3$ are independently selected from —O—, —S—, —$NR_1$—, and —CO—$NR_2$—; $R_1$ is selected from alkyl, substituted alkyl, aryl, substituted aryl, heteroaryl, and substituted heteroaryl; $R_2$ is selected from —H, alkyl, and substituted alkyl; $R_3$ is selected from alkyl; and substituted alkyl; $R_4$ to $R_7$ are each independently selected from alkyl, substituted alkyl, aryl, substituted aryl, arylalkyl, substituted arylalkyl, heteroaryl, and substituted heteroaryl; $R_9$ to $R_{16}$ are each independently selected from —H, methyl, ethyl, isopropyl, phenyl, substituted phenyl, benzyl, substituted benzyl, cyclopropyl, and —$(CH_2)_2$-COOH or salts; n, m, p and q are each independently 0 or 1; x is 0 or 1; Z is selected from —O—, —S—, —$NR_1$—, —CH═CH—, and —$C(CH_3)_2$; G represents the atoms necessary to complete a carbocyclic ring or a heterocyclic ring; Y represents the atoms necessary to complete a carbocyclic ring or a heterocyclic ring; γ is selected from alkyl, —Cl, —Br, —I, alkoxy, methoxy, ethoxy, hydroxy, —S—$CH_3$, phenyl, substituted phenyl, annulated benzo-ring, 1-indolyl, 1-pyrrolyl, 2-pyrrolyl, 3-pyrrolyl, 2-thienyl, 3-thienyl, 2-furyl, 3-furyl, —NH—CO-$R_{17}$, —CO—$NHR_{17}$, —NH—CO—$NHR_{17}$, —NH—$SO_2$—$NHR_{17}R$, —CN, —$CF_3$, —$SO_2$—$CF_3$, —$SO_2$—$CH_3$, —$SO_2$—$NR_2R_3$, —$CO_2$—$R_2$, and —CO—$NR_2R_2$; and $R_{17}$ is selected from an alkyl containing 1 to 6 carbon atoms, 2-furyl and 2-thienyl.

8. The process according to claim 1, wherein said chemically sensitizing merocyanine dye comprising formula (I) or (II) or (III) wherein (I)=

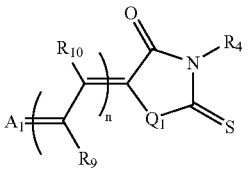

(II)=

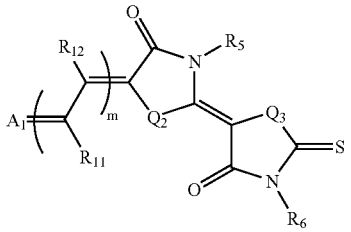

(III)=

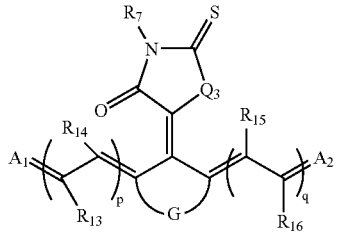

wherein $A_1$ and $A_2$ are each independently selected from one of the following structures:

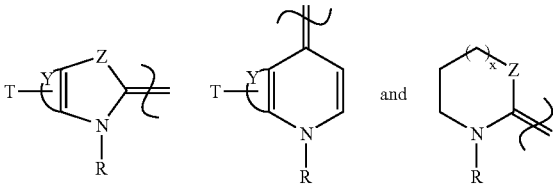

R is selected from alkyl, substituted alkyl, arylalkyl, and substituted arylalkyl; $Q_1$, $Q_2$ and $Q_3$ are independently selected from —O—, —S——$NR_1$—, and—CO—$NR_2$—; $R_1$ is selected from alkyl, substituted alkyl, aryl, substituted aryl, heteroaryl, and substituted heteroaryl; $R_2$ is selected from —H, alkyl, and substituted alkyl; $R_3$is selected from alkyl; and substituted alkyl; $R_4$ to $R_7$ are each independently selected from methyl, ethyl, hydroxy ethyl, —$(CH_2)_r$COOH or salts, —$(CH_2)_s$—$SO_3H$ or salts, —$(CH_2)_r$—CO—NH—$SO_2$—$R_8$ or salts, —$(CH_2)_s$, —$SO_2$—NH—CO—$R_8$ or salts, —$(CH_2)_s$—$SO_2$—NH—$SO_2$—$R_8$ or salts, carboxy-methyl, carboxy-ethyl, 2-sulpho-ethyl, 3-sulpho-propyl, 4-sulpho-butyl, and —$CH_2$—CO—NH—$SO_2$—$CH_3$ or salts; $R_8$ is selected from alkyl and substituted alkyl; $R_9$ to $R_{16}$ are each independently selected from —H, methyl, ethyl, isopropyl, phenyl, substituted phenyl, benzyl, substituted benzyl, cyclopropyl, and —$(CH_2)_2$—COOH or salts; n, m, p and q are each independently 0, 1, 2 or 3; r is 1, 2, 3, 4, 5 or 6; s is 2, 3 or 4; x is 0 or 1; Z is selected from —O—, —S—, —$NR_1$—, —CH═CH—, and —$C(CH_3)_2$—; G represents the atoms necessary to complete a carbocyclic ring or a heterocycli ring; Y represents the atoms necessary to complete a carbocyclic ring or a heterocyclic ring; T is selected from alkyl, —Cl, —Br, —I, alkoxy, methoxy, ethoxy, hydroxy, —S—$CH_3$, phenyl, substituted phenyl, annulated benzo-ring, 1-indolyl, 1-pyrrolyl, 2-pyrrolyl, 3-pyrrolyl, 2-thienyl, 3-thienyl, 2-furyl, 3-furyl, —NH—CO—$R_{17}$, —CO—$NHR_{17}$, —NH—CO—$NHR_{17}$, —NW—$SO_2$—$NHR_{17}$, —CN, —$CF_3$, —$SO_2$—$CF_3$, —$SO_2$—$CH_3$, —$SO_2$—$NR_2R_3$, —$CO_2$—$R_2$, and —CO—$NR_2R_2$; and $R_{17}$ is selected from an alkyl containing 1 to 6 carbon atoms, 2-furyl, and 2-thienyl.

9. The process according to claim 1, wherein said chemically sensitizing merocyanine dye comprising formula (I) or (II) or (III) wherein (I)=

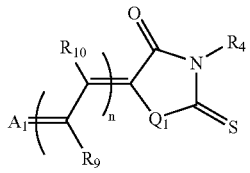

(II)=

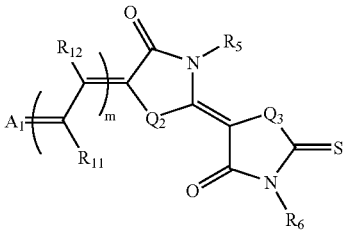

-continued (III)= 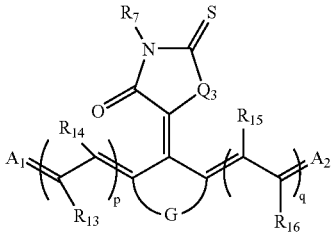

wherein $A_1$ and $A_2$ are each independently selected from one of the following structures:

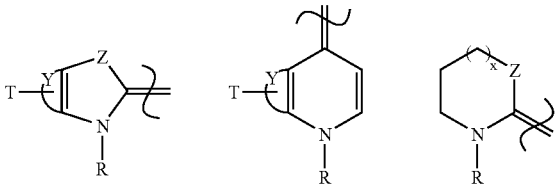

R is selected from alkyl, substituted alkyl, arylalkyl, and substituted arylalkyl; $Q_1$, $Q_2$ and $Q_3$ are independently selected from —O—, —S—, —$NR_1$—, and —CO—$NR_2$—; $R_1$ is selected from alkyl, substituted alkyl, aryl, substituted aryl, heteroaryl, and substituted heteroaryl; $R_2$ is selected from —H, alkyl, and substituted alkyl; $R_3$ is selected from alkyl; and substituted alkyl; $R_4$ to $R_7$ are each independently selected from methyl, ethyl, hydroxy ethyl, —$(CH_2)_r$—COOH or salts, —$(CH_2)_s$—$SO_3H$ or salts, —$(CH_2)_r$—CO—NH—$SO_2$—$R_8$ or salts, —$(CH_2)_s$—$SO_2$—NH—CO—$R_8$ or salts, —$(CH_2)_s$—$SO_2$—NH—$SO_2$—$R_8$ or salts, carboxy-methyl, carboxy-ethyl, 2-sulpho-ethyl, 3-sulpho-propyl, 4-sulpho-butyl and —$CH_2$—CO—NH—$SO_2$—$CH_3$ or salts; $R_8$ is selected from alkyl and substituted alkyl; $R_9$ to R16 are each independently selected from —H, methyl, ethyl, isopropyl, phenyl, substituted phenyl, benzyl, substituted benzyl, cyclopropyl, and —$(CH_2)_2$—COOH or salts; n, m, p and q are each independently 0 or 1; r is 1, 2, 3, 4, 5 or 6; s is 2, 3 or 4; x is 0 or 1; Z is selected from —O—, —S—, —$NR_1$—, —CH═CH—, and —$C(CH_3)_2$—; G represents the atoms necessary to complete a carbocyclic ring or a heterocyclic ring; Y represents the atoms necessary to complete a carbocyclic ring or a heterocyclic ring; T is selected from alkyl, —Cl, —Br, —I, alkoxy, methoxy, ethoxy, hydroxy, —S—$CH_3$, phenyl, substituted phenyl, annulated benzo-ring, 1-indolyl, 1—pyrrolyl, 2-pyrrolyl, 3-pyrrolyl, 2-thienyl, 3-thienyl, 2-furyl, 3-furyl, —NH—CO—$R_{17}$, —CO—$NHR_{17}$, —NH—CO—$NHR_{17}$, —NH—$SO_2$—$NHR_{17}$, —CN, —$CF_3$, —$SO_2$—$CF_3$, —$SO_2$—$CH_3$, —$SO_2$—$NR_2R_3$, —$CO_2$—$R_2$, and —CO—$NR_2R_2$; and $R_{17}$ is selected from an alkyl containing 1 to 6 carbon atoms, 2-furyl and 2-thienyl.

10. The process according to claim 1, wherein said chemically sensitizing merocyanine dye comprising formula (I) or (II) or (III) wherein (I)= 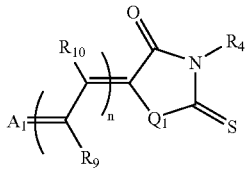

(II)= 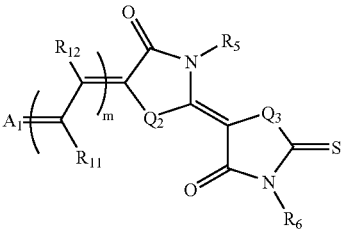

(III)= 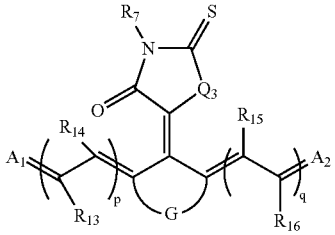

wherein $A_1$ and $A_2$ are each independently selected from one of the following structures:

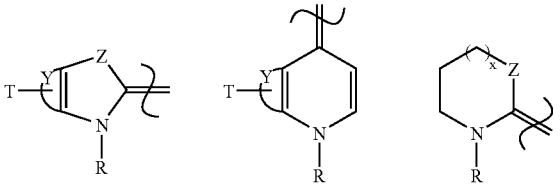

R is selected from methyl, ethyl, hydroxy ethyl, —$(CH_2)_r$—COOH or salts, —$(CH_2)_s$—$SO_3H$ or salts, —$(CH_2)_r$—CO—NH—$SO_2$—$R_3$ or salts, —$(CH_2)_s$—$SO_2$—NH—CO—$R_3$ or salts, —$(CH_2)_s$—$SO_2$—NH—$SO_2$—$R_3$ or salts, carboxy-methyl, carboxy-ethyl, 2-sulpho-ethyl, 3-sulpho-propyl, 4-sulpho-butyl, and —$CH_2$—CO—NH—$SO_2$—$CH_3$ or salts; $Q_1$, $Q_2$ and $Q_3$ are independently selected from —O—, —S—, —$NR_1$—, and —CO—$NR_2$—; $R_1$ is selected from alkyl, substituted alkyl, aryl, substituted aryl, heteroaryl, and substituted heteroaryl; $R_2$ is selected from —H, alkyl, and substituted alkyl; $H_3$ is selected from alkyl and substituted alkyl; $R_4$ to $R_7$ are each independently selected from alkyl, substituted alkyl, aryl, substituted aryl, arylalkyl, substituted arylalkyl, heteroaryl and substituted heteroaryl; $R_9$ to $R_{16}$ are each independently selected from —H, methyl, ethyl, isopropyl, phenyl, substituted phenyl, bentyl, substituted benzyl, cyclopropyl, and —$(CH_2)_2$—COOH or salts; n, m, p and q are each independently 0, 1, 2 or 3; r is 1, 2, 3, 4, 5 or 6; s is 2, 3 or 4; x is 0 or 1; Z is selected from —O—, —S—, —$NR_1$—, —CH═CH—, —$C(CH_3)_2$—; G represents the atoms necessary to complete a carbocyclic ring or a heterocyclic ring; Y represents the atoms necessary to complete a carbocyclic ring or a heterocyclic ring; T is selected from alkyl, —CI, —Br, —I, alkoxy, methoxy, ethoxy, hydroxy, —S—$CH_3$, phenyl, substituted phenyl, annulated benzo-ring, 1-indolyl, 1-pyrrolyl, 2-pyrrolyl, 3-pyrrolyl, 2-thienyl, 3-thienyl, 2-furyl, 3-furyl, —NH—CO—$R_{17}$, —CO—$NHR_{17}$, —NH—CO—$NHR_{17}$, —NH—$SO_2$—$NHR_{17}$, —CN, —$CF_3$, —$SO_2$—$CF_3$, —SO—$CH_3$, —$SO_2$—$NR_2R_3$, —$CO_2$—$R_2$, and —CO—$NR_2R_2$; and $R_{17}$ is selected from an alkyl containing 1 to 6 carbon atoms, 2-furyl, and 2-thienyl.

11. The process according to claim 1, wherein said chemically sensitizing merocyanine dye comprising formula (I) or (II) or (III) wherein (I)=

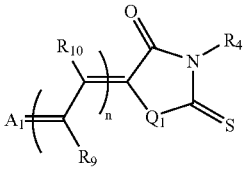

(II)=

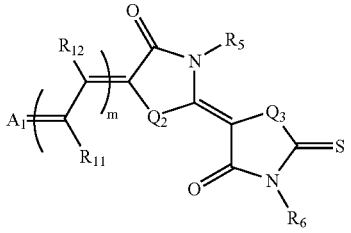

(III)=

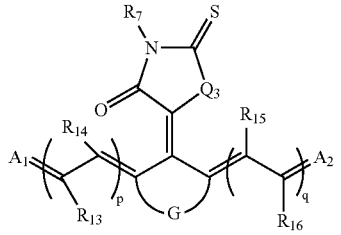

wherein $A_1$ and $A_2$ are each independently selected from one of the following structures:

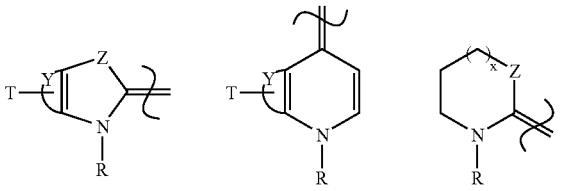

R is selected from methyl, ethyl, hydroxy ethyl, —$(CH_2)_r$—COOH or salts, —$(CH_2)_s$—$SO_3H$ or salts, —$(CH_2)_r$—CO—NH—$SO_2$—$R_3$ or salts, —$(CH_2)_s$—$SO_2$—NH—CO—$R_3$ or salts, —$(CH_2)_s$—$SO_2$—NH—$SO_2$—$R_3$ or salts, carboxy-methyl, carboxy-ethyl, 2-sulpho-ethyl, 3-sulpho-propyl, 4-sulpho-butyl, and —$CH_2$—CO—NH—$SO_2$—$CH_3$ or salts; $Q_1$, $Q_2$ and $Q_3$ are independently selected from —O —, —S—, —$NR_1$—, and —CO—$NR_2$—; $R_1$ is selected from alkyl, substituted alkyl, aryl, substituted aryl, heteroaryl, and substituted heteroaryl; $R_2$ is selected from —H, alkyl, and substituted alkyl; $R_3$ is selected from alkyl; and substituted alkyl; $R_4$ to $R_7$ are each independently selected from alkyl, substituted alkyl, aryl, substituted aryl, arylalkyl, substituted arylalkyl, heteroaryl, and substituted heteroaryl; $R_9$ to $R_{16}$ are each independently selected from —H, methyl, ethyl, isopropyl, phenyl, substituted phenyl, benzyl, substituted benzyl, cyclopropyl, and —$(CH_2)_2$—COOH or salts; n, m, p and q are each independently 0 or 1; r is 1, 2, 3, 4, 5 or 6; s is 2, 3 or 4; x is 0 or 1; Z is selected from —O—, —S—, —$NR_1$—, —CH═CH—, and —$C(CH_3)_2$—; G represents the atoms necessary to complete a carbocyclic ring or a heterocyclic ring; Y represents the atoms necessary to complete a carbocyclic ring or a heterocyclic ring; T is selected from alkyl, —Cl, —Br, —I, alkoxy, methoxy, ethoxy, hydroxy, —S—$CH_3$, phenyl, substituted phenyl, annulated benzo-ring, 1-indolyl, 1-pyrrolyl, 2-pyrrolyl, 3-pyrrolyl, 2-thienyl, 3-thienyl, 2-furyl, 3-furyl, —NH—CO—$R_{17}$, —CO—$NHR_{17}$, —NH—CO—$NHR_{17}$, —NH—$SO_2$—NHR17, —CN, —$CF_3$, —$SO_2$—$CF_3$, —$SO_2$—$CH_3$, —$SO_2$—$NR_2$, $R_3$—$CO_2$—$R_2$, and —CO—$NR_2R_2$; and $R_{17}$ is selected from an alkyl containing 1 to 6 carbon atoms, 2-furyl and 2-thienyl.

12. The process according to claim 1, wherein said chemically sensitizing merocyanine dye comprising formula (I) or (II) or (III) wherein (I)=

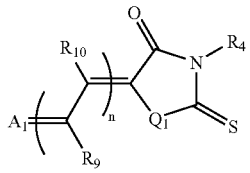

(II)=

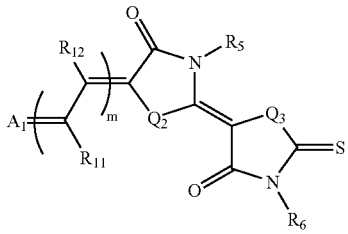

(III)=

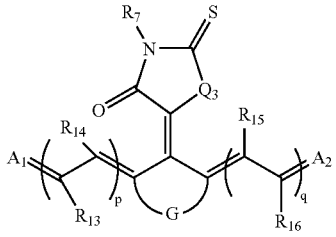

wherein $A_1$ or and $A_2$ are each independently selected from one of the following structures:

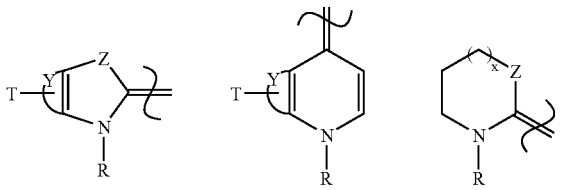

R is selected from methyl, ethyl, hydroxy ethyl, —$(CH_2)_r$—COOH or salts, —$(CH_2)_s$—$SO_3H$ or salts, —$(CH_2)_r$—CO—NH—$SO_2$—$R_3$ or salts, —$(CH_2)_s$—$SO_2NH$—CO—$R_3$ or salts, —$(CH_2)_s$—$SO_2$—NH—$SO_2$—$R_3$ or salts, carboxy-methyl, carboxy-ethyl, 2-sulpho-ethyl, 3-sulpho-propyl, 4-sulpho-butyl, and —$CH_2$—CO—NH—$SO_2$—$CH_3$, or salts; $Q_1$, $Q_2$ and $Q_3$ are independently selected from —O—, —S—, —$NR_1$—, and —CO—$NR_2$—; $R_1$ is selected from alkyl, substituted alkyl, aryl, substituted aryl, heteroaryl, and substituted heteroaryl; $R_2$is selected from —H, alkyl, and substituted alkyl; $R_3$ is selected from alkyl and substitured alkyl; $R_4$ to $R_7$ are each independently selected from methyl, ethyl, hydroxy ethyl, —$(CH_2)_r$—COOH or salts, —$(CH_2)_s$—$SO_3H$ or salts, —$(CH_2)_r$—CO—NH—$SO_2$—$R_8$ or salts, —$(CH_2)_s$—$SO_2$—NH—CO—$R_8$ or salts, —$(CH_2)_s$—$SO_2$—NH—$SO_2$—$R_8$ or salts, carboxy-methyl, carboxy-ethyl, 2-sulpho-ethyl, 3-sulpho-propyl, 4-sulpho-butyl, and —$CH_2$—CO—NH—$SO_2$—$CH_3$ or salts; $R_8$ is selected from alkyl and substituted alkyl; $R_9$ to $R_{16}$ are each independently selected from —H, methyl, ethyl, isopropyl, phenyl, substituted phenyl, benzyl, substituted benzyl, cyclopropyl, and —$(CH_2)_2$—COOH or salts; n, m, p and q are each independently 0, 1, 2 or 3; r is 1, 2, 3, 4, 5 or 6; s is 2, 3 or 4; x is 0 or 1; Z is selected from —O—, —S—, —$NR_1$—, —CH═CH—, and —$C(CH_3)_2$—; G represents the atoms necessary to complete a carbocyclic ring or a heterocyclic ring; Y represents the atoms necessary to complete a carbocyclic ring or a heterocyclic ring; T is selected from alkyl, —Cl, —Br, —I, alkoxy, methoxy, ethoxy, hydroxy, —S—$CH_3$, phenyl, substituted phenyl, annulated benzo—ring, 1-indolyl, 1-pyrrolyl, 2-pyrrolyl, 3-pyrrolyl, 2-thienyl, 3-thienyl, 2-furyl, 3-furyl, —NH—CO—$R_{17}$, —CO—$NHR_{17}$, —NH—CO—$NHR_{17}$, —NH—$SO_2$—$NHR_{17}$, —CN, —$CF_3$, —$SO_2$—$CH_3$, —$SO_2$—$NR_2R_3$, and —$CO_2$—$R_2$, —CO—$NR_2$ $R_2$; and $R_{17}$is selected from an alkyl containing 1 to 6 carbon atoms, 2-furyl, and 2-thienyl.

13. The process according to claim 1, wherein said chemically sensitizing merocyanine dye comprising formula (I) or (II) or (III) wherein (I)=

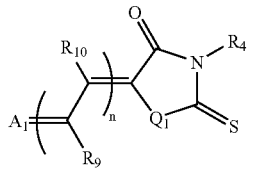

(II)=

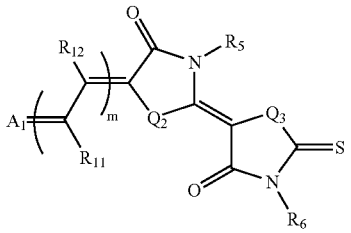

(III)=

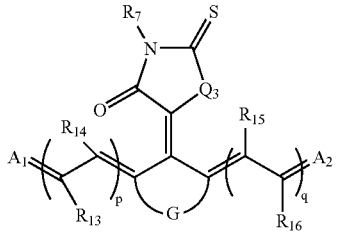

wherein $A_1$ and $A_2$ are each independently selected from one of the following structures:

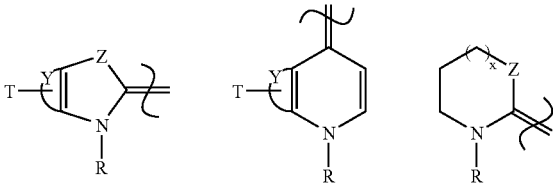

R is selected from methyl, ethyl, hydroxy ethyl, —$(CH_2)_r$—COOH or salts, —$(CH_2)_s$—$SO_3H$ or salts, —$(CH_2)_r$—CO—NH—$SO_2$—$R_3$ or salts, —$(CH_2)_s$—$SO_2$—NH—CO—$R_3$ or salts, —$(CH_2)_s$—$SO_2$—NH—$SO_2$—$R_3$ or salts, carboxy-methyl, carboxy-ethyl, 2-sulpho-ethyl, 3—sulpho-propyl, 4-sulpho-butyl, and —$CH_2$—CO—NH—$SO_2$—$CH_3$ or salts; $Q_1$, $Q_2$ and $Q_3$ are independently selected from —O—, —S—, —$NR_1$—, and —CO—$NR_2$—; $R_1$ is selected from alkyl, substituted alkyl, aryl, substituted aryl, heteroaryl, and substituted heteroaryl; $R_2$is selected from —H, alkyl, and substituted alkyl; $R_3$ is selected from alkyl, substituted alkyl; $R_4$ to $R_7$ are each independently selected from methyl, ethyl, hydroxy ethyl, —$(CH_2)_r$—COOH or salts, —$(CH_2)_s$—$SO_3H$ or salts, —$(CH_2)_r$—CO—NH—$SO_2$—$R_8$ or salts, —$(CH_2)_s$—$SO_2$—NH—CO—$R_8$or salts, —$(CH_2)_{s—SO2}$—NH—$SO_2$—$R_8$ or salts, carboxy-methyl, carboxy-ethyl, 2-sulpho-ethyl, 3-sulpho-propyl, 4-sulpho-butyl, and —$CH_2$—CO—NH—$SO_2$—$CH_3$ or salts; $R_8$ is selected from alkyl and substituted alkyl; $R_9$ to $R_{16}$ are each independently selected from —H, methyl, ethyl, isopropyl, phenyl, substituted phenyl, benzyl, substituted benzyl, cyclopropyl, and —$(CH_2)_2$—COOH or salts; n, m, p and q are each independently 0 or 1; r is 1, 2, 3, 4, 5 or 6; s is 2, 3 or 4; x is 0 or 1; Z is selected from —O—, —S—, —$NR_1$—, —CH═CH—, —$C(CH_3)_2$—; G represents the atoms necessary to complete a carbocyclic ring or a heterocyclic ring; Y represents the atoms necessary to complete a carbocyclic ring or a heterocyclic ring; T is selected from alkyl, —Cl, —Br, —I, alkoxy, methoxy, ethoxy, hydroxy, —S—$CH_3$, phenyl, substituted phenyl, annulated benzo-ring, 1-indolyl, 1-pyrrolyl, 2-pyrrolyl, 3-pyrrolyl, 2-thienyl, 3-thienyl, 2-furyl, 3-furyl, —NH—CO—$R_{17}$, —CO—$NHR_{17}$, —NH—CO—$NHR_{17}$, —NH—$SO_2$—$NHR_{17}$, —CN, —$CF_3$, —$SO_2$—$CF_3$, —$SO_2$—$CH_3$, —$SO_2$—$NR_2R_3$, —$CO_2$—$R_2$, and —CO—$NR_2R_2$; and $R_{17}$ is selected from an alkyl containing 1 to 6 carbon atoms, 2-fury, and 2-thienyl.

14. The process according to claim 1, wherein said chemically sensitizing merocyanine dye comprises a rhodanine ring, a thiohydantoin ring, a thiobarbituric acid ring or a 2-thio- 4-oxo-oxazolidine ring, optionally substituted with methyl, ethyl, hydroxy ethyl, —$(CH_2)_r$—COOH or salts, —$(CH_2)_s$—$SO_3H$ or salts, —$(CH_2)_r$—CO—NH—$SO_2$—$R_8$ or salts, or salt, —$(CH_2)_s$—$SO_2$—NH—CO—$R_8$ or salts, —$(CH_2)_s$—$SO_2$—NH—$SO_2$or salts, carboxy-methyl, carboxy-ethyl, 2-sulpho-ethyl, 3-sulpho-propyl, 4-sulpho-butyl, or —$CH_2$—CO—NH—$SO_2$—$CH_3$ wherein $R_8$ is selected from alkyl and substituted alkyl; r is 1, 2, 3, 4, 5 or 6; and s is 2, 3 or 4.

15. A photothermographic material with increased photosensitivity obtained by a process for preparing a photothermographic material with increased photosensitivity, said photothermographic material comprising a support and a photo-addressable thermally developable element, exclusive of a compound R—S(M)$_n$ wherein R is an aliphatic hydrocarbon, aryl or heterocyclic group, M is a hydrogen atom, or cation, and letter n is a number determined so as to render the molecule neutral and also exclusive of a compound capable of releasing a mobile dye corresponding to or inversely corresponding to the reduction of silver halide to silver at elevated temperatures, said photo-addressable thermally developable element containing a light-insensitive organic silver salt, a photosensitive agent in catalytic association with said light-insensitive organic silver salt, a reducing agent for said light-insensitive organic silver salt in thermal working relationship therewith, a silver salt having a water-solubility greater than 0.1 g in 1 L water at 20° C. and a binder, comprising the steps of:

(i) increasing the photosensitivity of a photosensitive silver halide by chemical sensitisation with a chemical sensitising merocyanine dye containing a thione group in a non-oxidative aqueous medium, optionally in the presence of said light-insensitive organic silver salt and/or in the presence of said silver salt having a water-solubility greater than 0.1 g in 1 L water at 20° C., thereby preparing said photosensitive agent;

(ii) coating said support with one or more aqueous solutions or dispersions together containing said light-insensitive organic silver salt, said photosensitive agent, said reducing agent, said silver salt having a water-solubility greater than 0.1 g in 1 L water at 20° C. and said binder; and (iii) drying said coating or coatings thereby producing said photo-addressable thermally developable element.

* * * * *